US006735403B2

(12) United States Patent
Kanno et al.

(10) Patent No.: US 6,735,403 B2
(45) Date of Patent: May 11, 2004

(54) IMAGE FORMING APPARATUS TO WHICH A DEVELOPING CARTRIDGE OR PROCESS CARTRIDGE ARE DETACHABLY MOUNTABLE COMPRISING DRIVING CONTROL MEANS FOR PERMITTING AND PREVENTING TRANSMISSION OF A DRIVING FORCE TO A WINDING MEMBER

(75) Inventors: Kazuhiko Kanno, Kanagawa-ken (JP); Tatsuya Shiratori, Kanagawa-ken (JP); Kouji Hashimoto, Shizouka-ken (JP); Tachio Kawai, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/899,021

(22) Filed: Jul. 6, 2001

(65) Prior Publication Data

US 2002/0031368 A1 Mar. 14, 2002

(30) Foreign Application Priority Data

Jul. 7, 2000 (JP) ..... 2000/206942

(51) Int. Cl.[7] ..... G03G 15/08
(52) U.S. Cl. ..... 399/103; 399/106
(58) Field of Search ..... 399/36, 37, 102, 399/103, 106, 111, 167; 222/DIG. 1

(56) References Cited

U.S. PATENT DOCUMENTS

| | | | | |
|---|---|---|---|---|
| 4,076,149 | A | 2/1978 | Saxinger | 222/202 |
| 4,998,140 | A | 3/1991 | Satou et al. | |
| 5,493,327 | A | 2/1996 | McCallum et al. | |
| 5,729,796 | A | 3/1998 | Miura et al. | 399/114 |
| 5,740,500 | A | 4/1998 | Hashimoto | 399/114 |
| 5,768,658 | A | 6/1998 | Watanabe et al. | 399/111 |
| 5,815,644 | A | 9/1998 | Nishiuwatoko et al. | 399/113 |
| 5,870,655 | A | 2/1999 | Nishiuwatoko et al. | 399/111 |
| 5,893,006 | A | 4/1999 | Kanno et al. | 399/13 |
| 5,903,803 | A | 5/1999 | Kawai et al. | 399/116 |
| 5,923,924 | A | 7/1999 | Hashimoto | 399/111 |
| 5,926,666 | A | 7/1999 | Miura et al. | 399/25 |
| 5,937,240 | A | 8/1999 | Kanno et al. | 399/111 |
| 5,940,657 | A | 8/1999 | Yokomori et al. | 399/119 |

(List continued on next page.)

FOREIGN PATENT DOCUMENTS

| | | |
|---|---|---|
| EP | 0 743 570 | 11/1996 |
| EP | 0 923 004 | 6/1999 |
| EP | 1 107073 | 6/2001 |
| JP | 1-193872 | 8/1989 |

OTHER PUBLICATIONS

Patent Abstracts of Japan, vol. 13, No. 4388, Nov. 7, 1989 (JP 1–193872).

*Primary Examiner*—Hoang Ngo
(74) *Attorney, Agent, or Firm*—Fitzpatrick, Cella, Harper & Scinto

(57) ABSTRACT

A process cartridge detachably mountable to a main assembly of an image forming apparatus includes an electrophotographic photosensitive member; developing device for developing an electrostatic latent image formed on the electrophotographic photosensitive member with a developer; a developer container for containing the developer, the developer container having an opening for supplying the developer to the developing means; a sealing member for sealing the opening of the developer container; a winding shaft for winding the sealing member, the sealing member being rotatably supported by the developer container; a driving device for applying a driving force to rotate the winding shaft; and drive control device for permitting and preventing transmission of the driving force to the winding shaft, wherein the driving control device permits the transmission in response to insertion of the process cartridge into the main assembly of the image forming apparatus and prevents transmission in response to a predetermined number of rotations of the winding shaft.

18 Claims, 23 Drawing Sheets

U.S. PATENT DOCUMENTS 5,950,049 A 9/1999 Yokomori et al. ..... 399/119
6,016,408 A 1/2000 Hashimoto et al. ..... 399/27
6,044,235 A 3/2000 Hashimoto ..... 399/99
6,055,406 A 4/2000 Kawai et al. ..... 399/360
6,070,029 A 5/2000 Nishiuwatoko et al. ..... 399/111
6,072,969 A 6/2000 Yokomori et al. ..... 399/119
6,101,352 A 8/2000 Hashimoto et al. ..... 399/119
6,115,567 A 9/2000 Kawai et al. ..... 399/106
6,128,454 A 10/2000 Kawai et al. ..... 399/116
6,151,459 A 11/2000 Hashimoto et al. ..... 399/27
6,163,665 A 12/2000 Watanabe et al. ..... 399/111
6,175,706 B1 1/2001 Watanabe et al. ..... 399/167
6,226,478 B1 5/2001 Watanabe et al. ..... 399/117
6,240,266 B1 5/2001 Watanabe et al. ..... 399/117
6,246,853 B1 6/2001 Suzuki et al. ..... 399/262

IMAGE FORMING APPARATUS TO WHICH A DEVELOPING CARTRIDGE OR PROCESS CARTRIDGE ARE DETACHABLY MOUNTABLE COMPRISING DRIVING CONTROL MEANS FOR PERMITTING AND PREVENTING TRANSMISSION OF A DRIVING FORCE TO A WINDING MEMBER

FIELD OF THE INVENTION AND RELATED ART

The present invention relates to a developing cartridge, a process cartridge and an electrophotographic image forming apparatus to which the process cartridge is mountable. The electrophotographic image forming apparatus forms an image on a recording material through an electrophotographic image-formation-type process. Examples of the electrophotographic image forming apparatus include an electrophotographic copying machine, an electrophotographic printer (a laser beam printer or an LED printer mountable), a facsimile machine, a word processor and the like. The process cartridge integrally contains an electrophotographic photosensitive drum, and charging means, developing means or cartridge, in the form of a unit or a cartridge, which is detachably mountable to a main assembly of an image forming apparatus. The process cartridge may contain the electrophotographic photosensitive drum, and at least one of charging means, developing means and cleaning means, in the form of a cartridge which is detachably mountable to the main assembly of the image forming apparatus. Furthermore, the process cartridge may contain at least the electrophotographic photosensitive drum and the developing means. The present invention is applicable to a process cartridge having developing means of such a structure.

Heretofore, in an electrophotographic image forming apparatus using the electrophotographic image process, a process-cartridge type, in which the electrophotographic photosensitive member and process means, actable on the electrophotographic photosensitive member, are integrally contained in a cartridge, which is detachably mountable to the main assembly of the image forming apparatus. Heretofore, in an electrophotographic image forming apparatus using the electrophotographic image process, a process cartridge type, in which the electrophotographic photosensitive member and process means, actable on the electrophotographic photosensitive member, are integrally contained in a cartridge, which is detachably mountable to the main assembly of the image forming apparatus.

Such a process cartridge contains a photosensitive drum, and developing means is used to apply the developer (toner) to the latent image formed on the photosensitive drum. In the developing means, a developing device frame supporting a developing roller for feeding the toner to the photosensitive drum and a toner frame (toner container) accommodating the toner, are coupled with each other. Before the start of use of the process cartridge, the opening provided in the connecting portion between the toner frame and the developing device frame are sealed by a seal member. A process cartridge equipped with an automatic toner seal removing device for automatically unsealing the opening of the toner frame when the process cartridge is mounted to the main assembly of the image forming apparatus, and an image forming apparatus, which is capable of driving the automatic toner seal winding device, are known.

The present invention provides a further development.

SUMMARY OF THE INVENTION

It is a principal object of the present invention to provide a developing cartridge, a process cartridge, and an image forming apparatus to which the process cartridge is mountable.

According to an aspect of the present invention, there is provided a process cartridge detachably mountable to a main assembly of an image forming apparatus, comprising: an electrophotographic photosensitive member; developing means for developing an electrostatic latent image formed on the electrophotographic photosensitive member with a developer; a developer container for containing the developer, the developer container having an opening for supplying the developer to the developing means; a sealing member for sealing the opening of the developer container; a winding shaft for winding the sealing member, the sealing member being rotatably supported by the developer container; driving means for applying a driving force to rotate the winding shaft; and drive control means for permitting and preventing transmission of the driving force to the winding shaft, wherein the driving control means permits the transmission in response to insertion of the process cartridge into the main assembly of the image forming apparatus and prevents transmission in response to a predetermined number of rotations of the winding shaft.

According to another aspect of the present invention, there is provided an electrophotographic image forming apparatus for forming an image on a recording material, to which a process cartridge is detachably mountable, the apparatus comprising: a. mounting means for detachably mounting the process cartridge, the process cartridge including: an electrophotographic photosensitive member; developing means for developing an electrostatic latent image formed on the electrophotographic photosensitive member with a developer; a developer container for containing the developer, the developer container having an opening for supplying the developer to the developing means; a sealing member for sealing the opening of the developer container; a winding shaft for winding the sealing member, the sealing member being rotatably supported by the developer container; driving means for applying a driving force to rotate the winding shaft; and drive control means for permitting and preventing transmission of the driving force to the winding shaft, wherein the driving control means permits the transmission in response to insertion of the process cartridge into the main assembly of the image forming apparatus and prevents transmission in response to a predetermined number of rotations of the winding shaft; b. feeding means for feeding the recording material; and c. driving means for driving the driving means of the process cartridge.

According to a further aspect of the present invention, there is provided a process cartridge detachably mountable to a main assembly of an image forming apparatus, comprising: developing means for developing an electrostatic latent image formed on an electrophotographic photosensitive member with a developer; a developer container for containing the developer, the developer container having an opening for supplying the developer to the developing means; a sealing member for sealing the opening of the developer container; a winding shaft for winding the sealing member, the sealing member being rotatably supported by the developer container; driving means for applying a driving force to rotate the winding shaft; and drive control means for permitting and preventing transmission of the driving force to the winding shaft, wherein the driving control means permits the transmission in response to insertion of the developing cartridge into the main assembly of the image forming apparatus and prevents transmission in response to a predetermined number of rotations of the winding shaft.

According to a further aspect of the present invention there is provided an electrophotographic image forming apparatus for forming an image on a recording material, to which a developing cartridge is detachably mountable, comprising: a. mounting means for detachably mounting the process cartridge, the process cartridge including: developing means for developing a latent image formed on an electrophotographic photosensitive member with a developer; a developer container for containing the developer, the developer container having an opening for supplying the developer to the developing means; a sealing member for sealing the opening of the developer container; a winding shaft for winding the sealing member, the sealing member being rotatably supported by the developer container; driving means for applying a driving force to rotate the winding shaft; and drive control means for permitting and preventing transmission of the driving force to the winding shaft, wherein the driving control means permits the transmission in response to insertion of the developing cartridge into the main assembly of the image forming apparatus and prevents transmission in response to a predetermined number of rotations of the winding shaft; b. feeding means for feeding the recording material; and c. driving means for driving the driving means of the process cartridge.

According to the present invention, it is not until the process cartridge is inserted into the image forming apparatus that drive transmission from the driving means to the winding-up shaft is permitted, and therefore, even if driving means is actuated for the purpose of inspection during the assembling of the process cartridge, the seal member is not unintentionally wound up. When the winding-up shaft rotates through a predetermined number of turns, the winding-up shaft is released from the driving, and therefore, the winding-up shaft is not driven after the sealing member is wound up. Thus, it can be avoided that an end portion of the seal member flappers with the result of toner scattering and/or different sound or the like. Additionally, the load of the driving source of the main assembly of the image forming apparatus can be reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Next, an embodiment of a development cartridge in accordance with the present invention, and an electrophotographic image forming apparatus which employs such a development cartridge, will be described.

Embodiment 1

First, referring to FIGS. 1–14, the general structure of an image forming apparatus in accordance with the present invention will be described.

[General Description of Image Forming Apparatus]

First, referring to FIG. 1, the general structure of a color image forming apparatus will be described.

Figure 1:
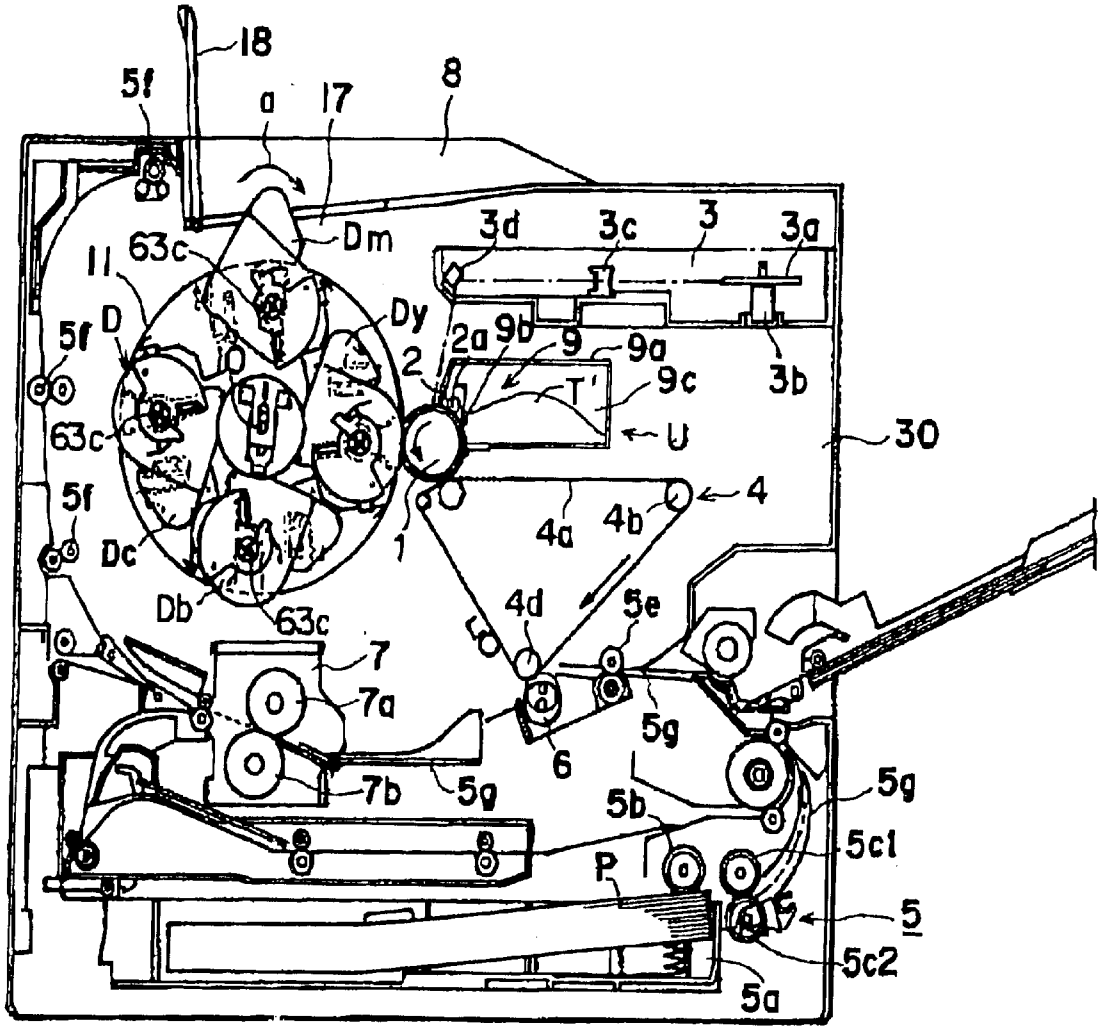
FIG. 1 is a longitudinal sectional view of a multi-color electrophotographic image forming apparatus.

FIG. 1 is a vertical sectional view of a laser printer, a form of a color image forming apparatus, for describing the general structure thereof.

The color laser printer comprises: a process cartridge U in which a photosensitive drum 1, which rotates at a constant velocity, is supported; an image forming portion comprising four rotatable development cartridges D; and an intermediary transfer member 4, which holds color images as the color images, are developed in the image forming portion and transferred onto the intermediary transfer member 4, and then transfers the color images onto a transfer medium P delivered to the intermediary transfer member 4 by a conveying means 5.

The transfer medium P onto which the color images have been just transferred is conveyed to a fixing portion, in which the color images are fixed to the transfer medium P. Thereafter, the transfer medium P is discharged by a discharge roller 5*f* into a delivery portion 8 located at the top of the apparatus. The rotatable development cartridges D are structured so that they can be individually mounted into or dismounted from the main assembly 30 of the printers.

Next, the structures of various components and portions of the image forming apparatus will be described detail.

[Process Cartridge]

The process cartridge U has a photosensitive drum 1, and a cleaning apparatus, the container portion 9*a* of which is an integral part of the process cartridge U and doubles as the holder for the photosensitive drum 1. It is removably supported by the printer main assembly 30 so that the process cartridge U, which is currently in the printer main assembly 30, can be easily replaced with a new process cartridge in accordance with the service life of the photosensitive drum 1.

The photosensitive drum 1 in this embodiment comprises an aluminum cylinder with a diameter of approximately 50 mm, and an organic photoconductor layer coated on the peripheral surface of the aluminum cylinder. It is rotationally supported by the cleaning apparatus container portion 9*a*, which doubles as the holder for photosensitive drum 1. In the adjacencies of the peripheral surface of the photosensitive drum 1, a cleaning blade 9*b* for removing the developer (toner) remaining on the peripheral surface of the photosensitive drum 1, and a primary charging means 2 for uniformly charging the peripheral surface of the photosensitive drum 1, are disposed.

The photosensitive drum 1 is rotated in the counterclockwise direction, as shown in the drawing, in synchronism with an image forming operation, by transmitting a driving force from an unshown motor to one end of the photosensitive drum 1, that is, the end on the rear side of the drawing.

[Charging Means]

The charging means 2 in this embodiment is such a charging means that employs a contact charging method, and comprises an electrically conductive roller 2*a*, which is placed in contact with the photosensitive drum 1. The peripheral surface of the photosensitive drum 1 is uniformly charged by applying a voltage to the charge roller 2*a* placed in contact with the peripheral surface of the photosensitive drum 1.

[Exposing Means]

The exposing of the photosensitive drum 1 is carried out by a scanner portion 3. More specifically, as image signals are given to a laser diode, the laser diode emits image light modulated with the image signals, at a polygon mirror 3*a*.

The polygon mirror 3*a* is rotated at a high velocity by a scanner motor 3*b*. While polygon mirror 3*a* is rotated at a high velocity, the image light is reflected by the polygon mirror 3*a*, passing through a focusing lens 3*c*, deflected by a reflection mirror 3*d*, and projected onto the peripheral surface of the photosensitive drum 1, which is being rotated at a predetermined constant velocity, selectively exposing the peripheral surface of the photosensitive drum 1. As a result, an electrostatic latent image is formed on the peripheral surface of the photosensitive drum 1.

[Developing Means]

The developing means is provided with four development cartridges Dy, Dm, Dc and Db, which are capable of visualizing, that is, developing, an electrostatic latent image in yellow, magenta, cyan, and black colors, correspondingly.

Figure 2:
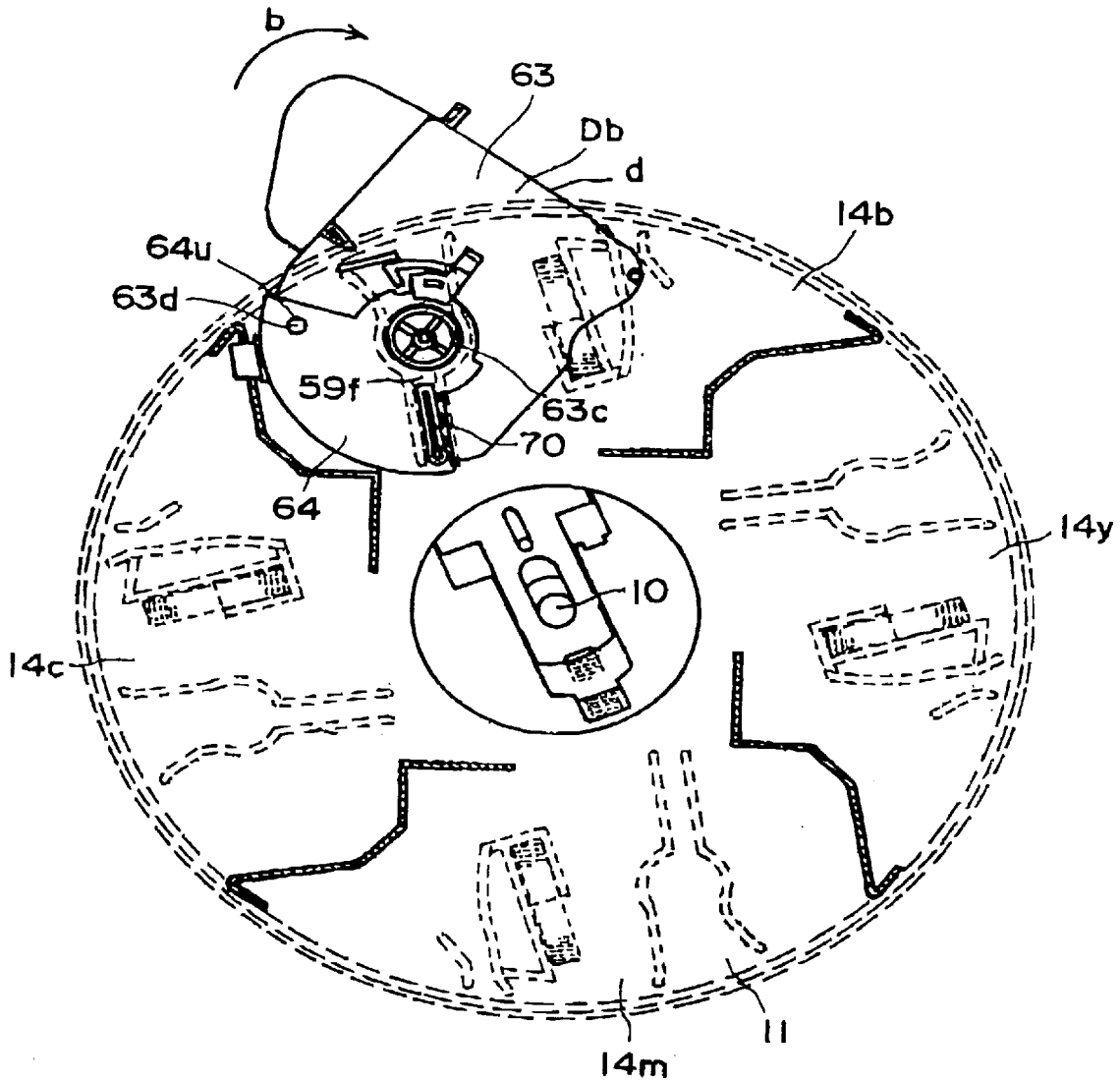
FIG. 2 is a front view of a development rotary member.
Figure 3:
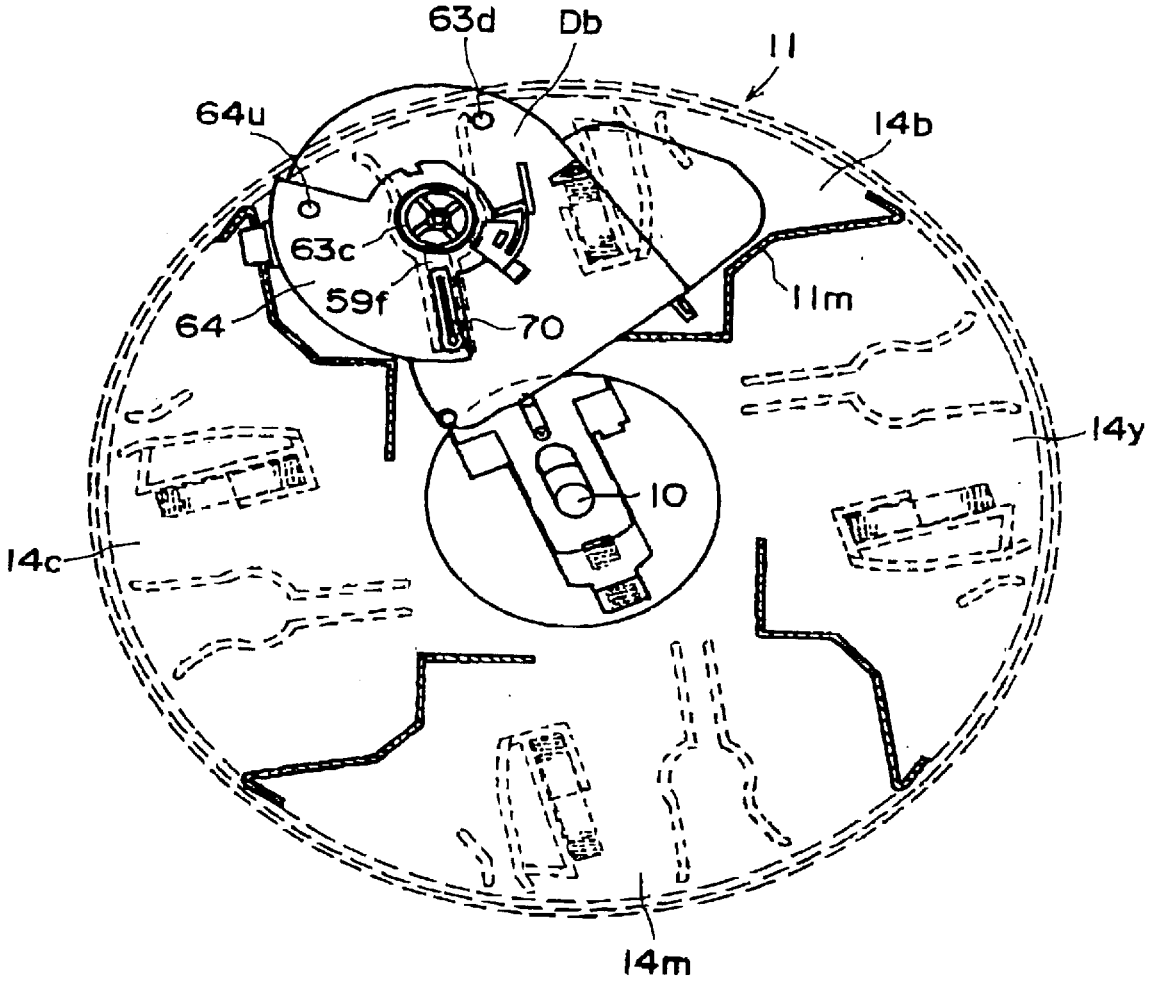
FIG. 3 a front view of a development rotary member.

Referring to FIGS. 1–3, each of the four development cartridges D is removably held by a rotary unit 11 enabled to rotate about a shaft 10. In an image forming operation, each development cartridge D is moved by the rotation of rotary unit 11 to a predetermined position, at which the development roller, which will be described later, opposes the photosensitive drum 1, holding a microscopic gap (approximately 300 $\mu$m) from the photosensitive drum 1, and forms a visible image which reflects the electrostatic latent image, on the photosensitive drum 1.

In a color image forming operation, each time the intermediary transfer member 4 rotates once, the rotary unit 11 also rotates once, moving the yellow development cartridge Dy, the magenta development cartridge Dm, the cyan development cartridge Dc, and the black development cartridge Db, in this order, to the above described predetermined position to carry out development processes.

Figure 4:
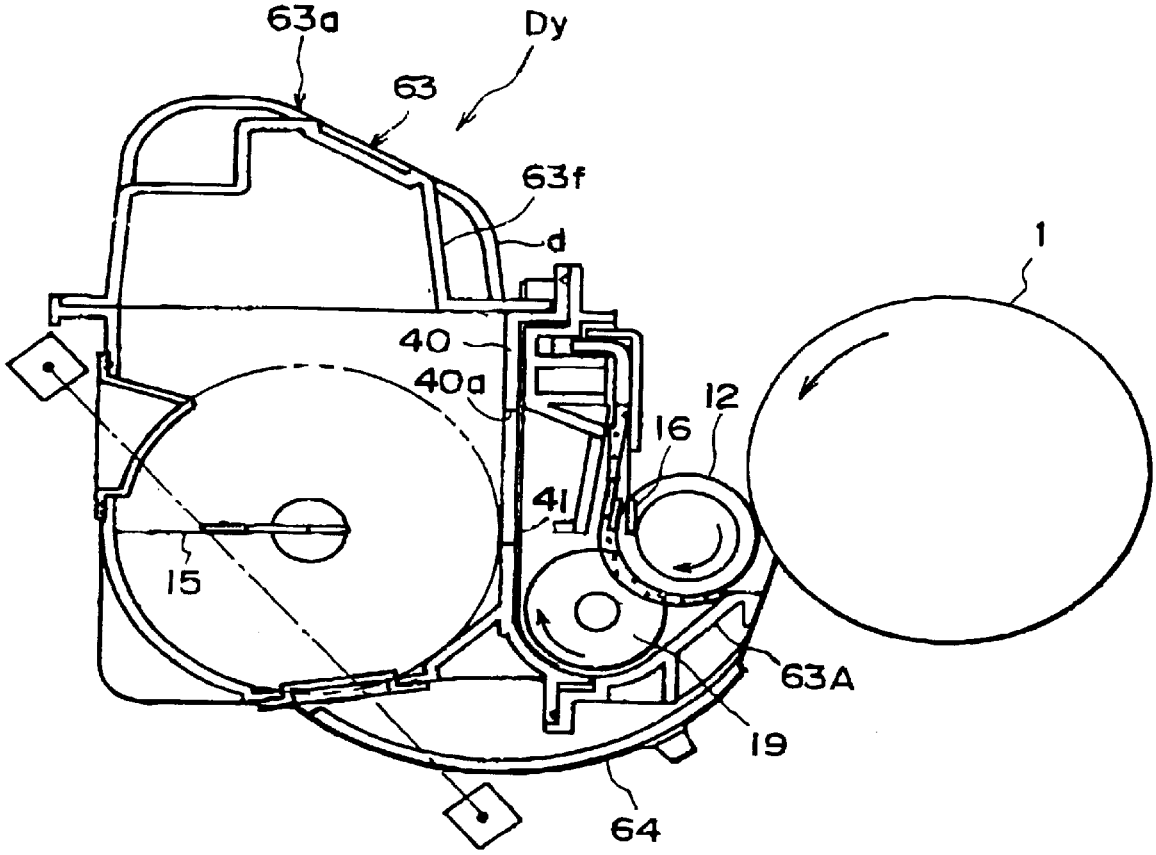
FIG. 4 is a longitudinal sectional view of a developing cartridge.

FIG. 4 shows the yellow development cartridge Dy which is standing still, being positioned to oppose the process cartridge U. In the development cartridge Dy, the toner in the toner container 63*a* is sent to a toner supplying roller 19 by a toner sending mechanism 15. Then, the toner is coated in a thin layer on the peripheral surface of the development roller 12, which is rotating in the clockwise direction indicated in the drawing, by the toner supplying roller 19, which is rotating in the clockwise direction indicated also in the drawing, and a development blade 16 which is kept pressed upon the peripheral surface of the development roller 12. While the toner is coated, the toner is given an electrical charge (triboelectrical charge).

Then, a development bias is applied to the development roller 12, which is opposing the photosensitive drum 1 on which a latent image has been formed, to form a toner image which reflects the latent image on the photosensitive drum 1. The same toner image forming process as the one described above with reference to the yellow development cartridge Dy is also carried out in the magenta development cartridge Dm, the cyan development cartridge Dn, and the black development cartridge Db, which have the same mechanism as the yellow development cartridge Dy described above.

The image forming apparatus main assembly 30 in structured so that, as each development cartridge D is rotated to the development position, its development roller 12 is connected to a high voltage power source and a mechanical driving means (unshown), and development bias is applied to the development roller 12. This process is carried out one after another for all development cartridges in the aforementioned order.

The yellow, magenta, and cyan development cartridges Dy, Dm and Dc, shown in FIG. 4, are the same in structure; they each have the toner supplying roller 19, which is rotationally supported by the developing means holding portion 63A of the cartridge frame 63. The peripheral surface of the toner supplying roller 19 moves in a direction opposite to the direction in which the peripheral surface of the development roller 12 moves.

Figure 5:
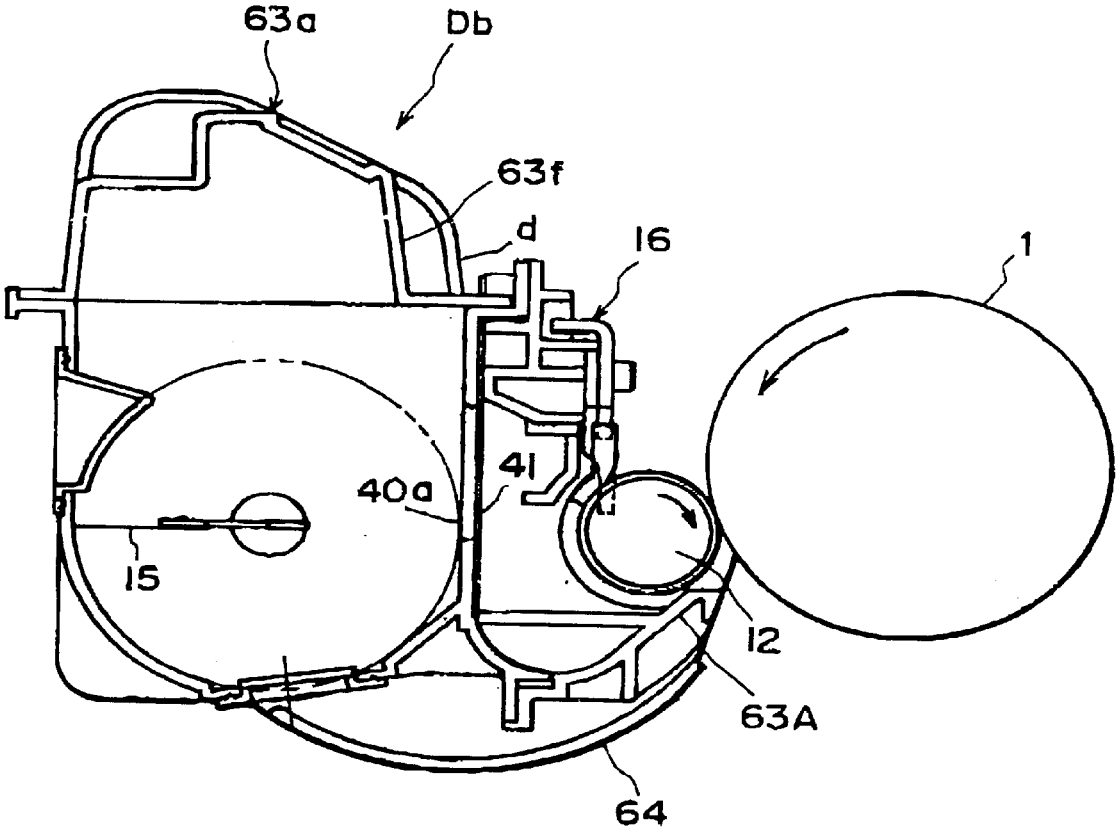
FIG. 5 is a longitudinal sectional view of the developing cartridge.

In comparison, the black development cartridge Db shown in FIG. 5 does not have the toner supplying roller 19; toner is adhered to the development roller 12 by magnetic force, or adheres to the development roller 12 due its own adhesive force, and the thickness of the toner layer on the development roller 12 is required by the development blade 16 placed in contact with the peripheral surface of the development roller 12. As the toner layer on the peripheral surface of the development roller 12 is regulated in thickness, the toner is given a triboelectrical charge.

[Intermediary Transfer Means]

The intermediary transfer member 4 is a member onto which a toner image is temporarily transferred. More specifically, each time one full-color image is formed, four toner images different in color (Y, M, C and Bk color images), or four visible images different in color, formed on the photosensitive drum 1 by the four developing means, one for one, are transferred in layers onto the intermediary transfer member 4, which is being rotated in the clockwise direction indicated in the drawing, at the same peripheral velocity as that of the photosensitive drum 1. The intermediary transfer member 4 having received a plurality toner images, in layers, transfers, all at once in layers, the color toner images thereon onto the transfer medium P by conveying the transfer medium P by sandwiching the transfer medium P between itself and the transfer roller 6 to which voltage is being applied. In the intermediary transfer member 4 in this embodiment, an endless transfer belt 4*e* formed of dielectric material sheet is stretched around a plurality of rollers, and is rotated by the driving roller in the direction indicated by an arrow.

[Cleaning Means]

The cleaning means 9 in a means for removing, from the photosensitive drum 1, the toner remaining on the photosensitive drum 1 after the toner image, or a visual image, formed on the photosensitive drum 1 by the developing means is transferred by the intermediary transfer member 4. The toner removed from the photosensitive drum 1, or residual toner T is collected in a residual toner container 9*a*. The amount of the residual toner in not large enough to fill up the residual toner container 9*a* before the service life of the photosensitive drum 1 expires. Thus, the residual toner container 9*a*, which is a part of the process cartridge U, is replaced with a new one, at the same time as the process cartridge U is replaced with a new one due to the expiration of the service life of the photosensitive drum 1.

[Sheet Feeding Portion]

The conveying means 5, the most upstream portion of which in terms of the recording-medium conveyance direction is a sheet feeder portion, is a means for conveying the transfer medium P to the image forming portion. It essentially comprises: a cassette 5*a* in which a plurality of transfer media P are stored; a sheet feeder roller 5*b*, a combination of a sheet feeder roller 5*c*1 and a retarder roller for preventing the recording medium P from being fed by two or more, a sheet guide 5*g*, and a registration roller 5*e*.

In an image forming operation, the sheet feeder roller 5*b* is rotationally driven in synchronism with the image forming operation to feed the recording media P within the cassette 5*a* into the apparatus main assembly, one by one. Then, each recording medium P is conveyed, while being guided by guiding plates (unshown), to the registration roller 5*e* past the sheet feeder roller 5*c*1.

During the image forming operation, the registration roller 5*e* carries out, in a predetermined sequence, a process in which it remains still to keep the transfer medium P on standby, and a process in which it rotates to release and convey the recording medium P toward the intermediary transfer member 4, so that the released transfer medium P aligns with an image during the following process, that is, the transfer process.

[Transferring Portion]

The transferring portion comprises the transfer roller 6, which can be moved in the direction to be pressed upon the transfer belt 4*a*, or in the direction to be separated therefrom. The transfer roller 6 comprises a metallic shaft, and a layer of foamed elastic material wrapped around the peripheral surface of the metallic shaft. The electrical resistance of the foamed elastic material layer is in the medium range. It is movable in the vertical direction of the drawing, and is connected to a mechanical driving means.

While the above mentioned four toner images are formed on the intermediary transfer member 4, that is, while the intermediary transfer member 4 rotates a plural number of times, the transfer roller 6 is kept at the bottom position outlined by a bold line in the drawing, being kept away from the intermediary transfer member 4, to prevent the transfer roller 6 from disturbing the images while they are being formed.

Then, as the formation of the four toner images different in color on the intermediary transfer member 4 ends, the transfer roller 6 is moved to the top position outlined by a fine line in the drawing, by an unshown cam, in synchronism with the timing with which the multi-color image, or the combination of the four color toner images, is to be transferred onto the transfer medium P. In other words, the transfer roller 6 is pressed upon the intermediary transfer member 4, with the interposition of the transfer medium P between the intermediary transfer or member 4 and transfer roller 6. At the same time as the transfer roller 6 is pressed upon the intermediary transfer member 4, bias begins to be applied to the transfer roller 6. As a result, the toner images on the intermediary transfer member 4 are transferred onto the transfer medium P.

The intermediary transfer member 4 and transfer roller 6 are driven independently from each other. Therefore, as the transfer process progresses, the transfer medium P being sandwiched between the two rollers is conveyed leftward of the drawing at a predetermined velocity to the fixing portion 7, in which the following process is carried out.

[Fixing Portion]

The fixing portion 7 is a portion for fixing the toner images, which have been formed on the photosensitive drum 1 by developing means and have been transferred onto the transfer medium P, to the transfer medium P. It comprises: a fixing roller 7*a* for applying heat to the transfer medium P, end a pressure roller 7*b* for pressing the transfer medium P upon the fixing roller 7*a*. Both rollers 7*a* and 7*b* are hollow and contain a heater. They are rotationally driven and convey together the transfer medium P.

More specifically, as the transfer medium P, which is holding the toner images, is conveyed by the fixing roller 7*a* and pressure roller 7*b*, heat and pressured are applied to the recording medium P and toner images thereon. As a result, the toner images are fixed to the transfer medium P.

Next, how the development cartridge is mounted will be described.

First, an unshown button of the printer main assembly 30 is pressed. As the button is pressed, the rotary unit 11 rotates until a specific development cartridge mounting slot of the rotary unit 11, the color designation of which matches the color of the development cartridge D the user wished to mount, comes to a predetermined position at which the development cartridge D can be mounted Next, the user opens the cover 18 of the development cartridge mounting opening 17 located at a predetermined portion of the printer main assembly 30. Normally the opening 17 is kept covered with the cover 18.

Then, the guide ribs 70 on the side walls of the shutter 64 (which will be described later in detail) of the development cartridge D, identical in color to the color designation of the development cartridge mounting slot 14, which is at this point aligned with the opening 17, rest on the cartridge guides 59*f* (FIGS. 2 and 3) on the internal walls of the rotary unit 11 of the apparatus main assembly 30, and the development cartridge D is pushed inward (FIG. 2). At this point, the operator grasps by hand the handhold recess 63*f* (FIG. 7) integral with the toner container portion 63*a* of the development cartridge D, and turns the development cartridge D in the direction indicated by an arrow mark (1) in FIG. 1. As the development cartridge D is turned, only the actual development unit D rotates, with the shutter remaining held to the rotary unit 11. As a result, the development roller 12 is exposed, to be ready for development (FIG. 5). The cartridge guide 59*f* and the relevant guides are provided at each quarter portion of the circumference of the rotary unit 11 (cartridge mounting portions 14*y*, 14*m*, 14*c*, 14*b*).

[Shutter]

Figure 6:
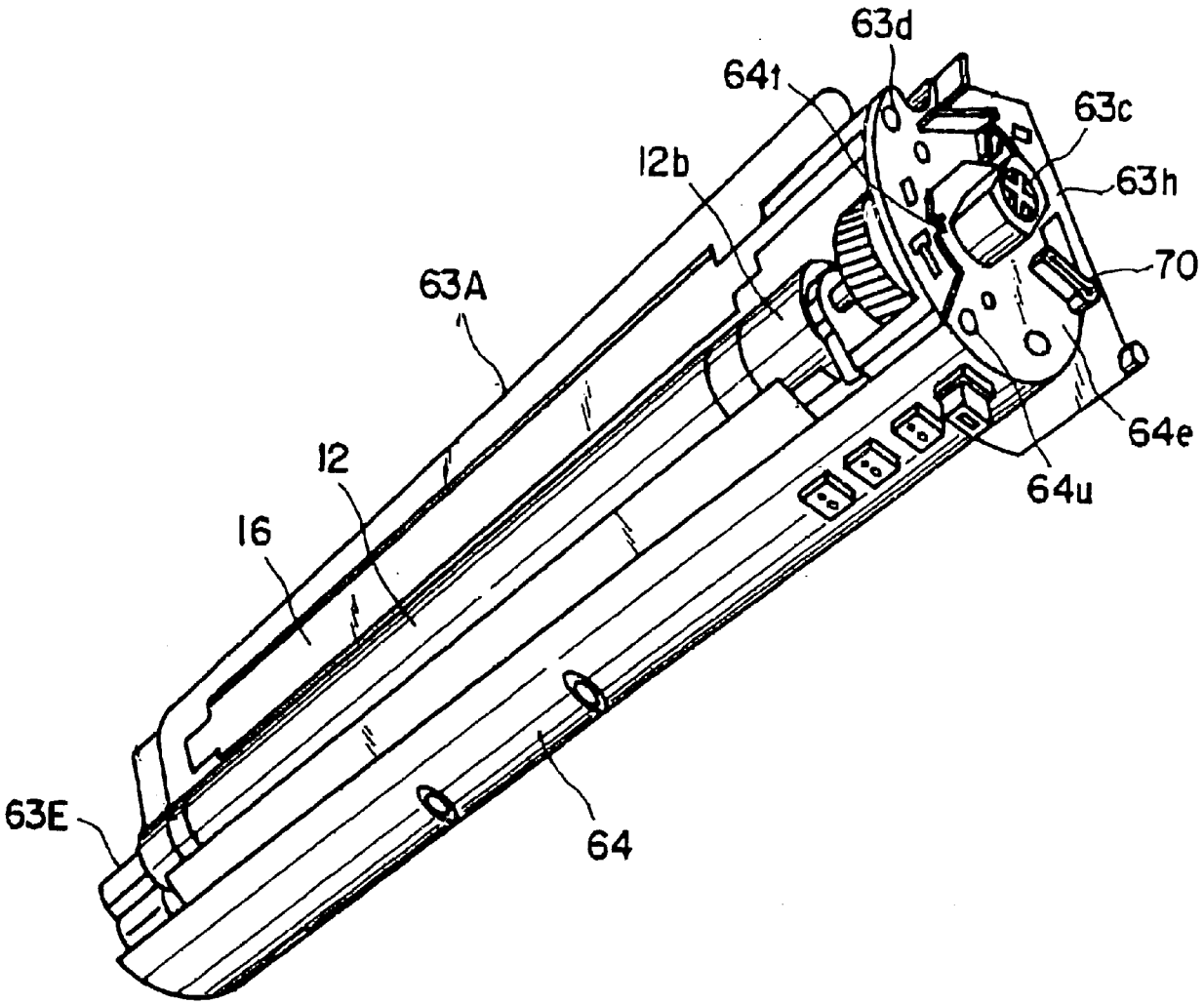
FIG. 6 is a perspective view of a developing cartridge.
Figure 7:
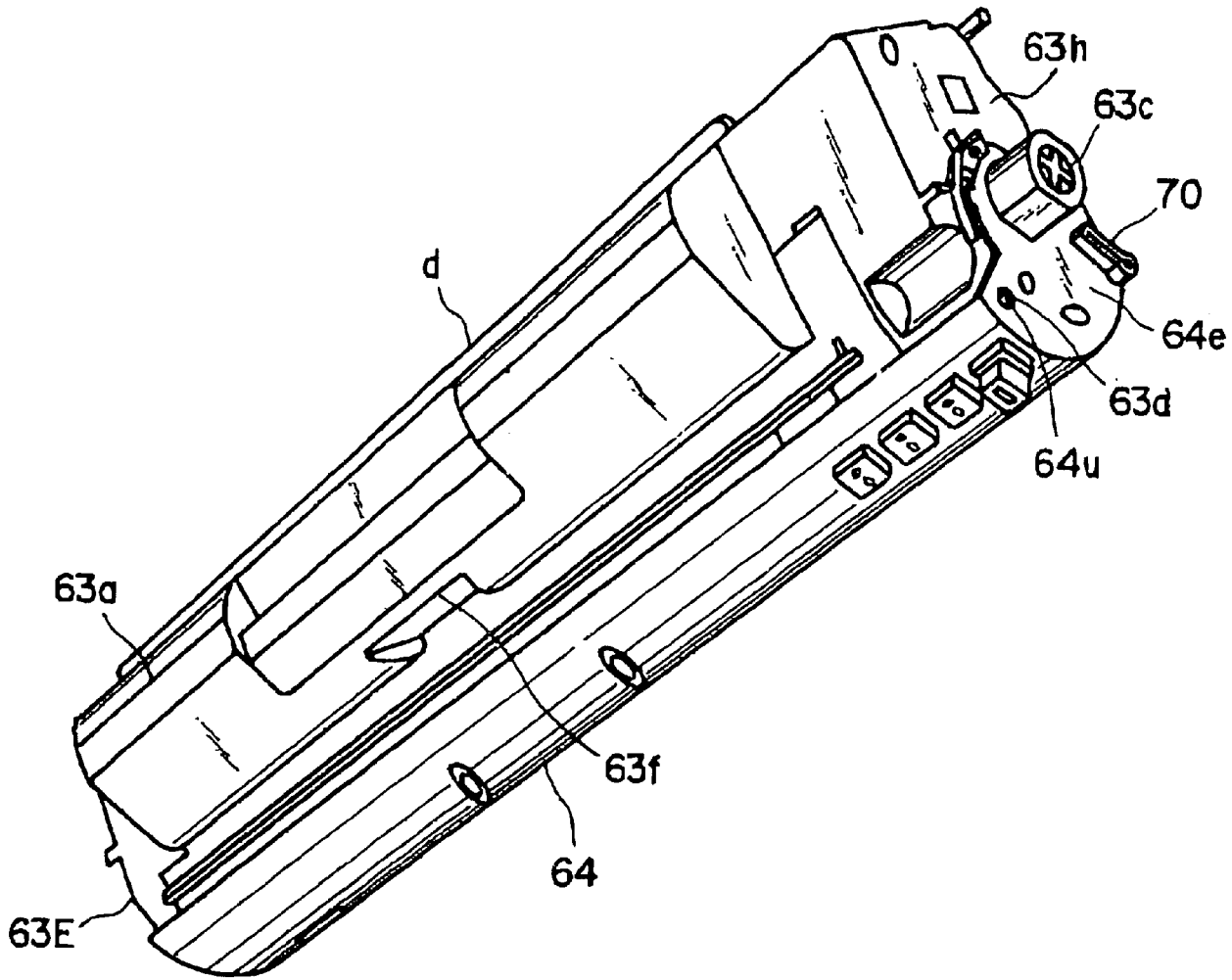
FIG. 7 is a perspective view of a developing cartridge.

Next, referring to FIGS. 6–8, the shutter 64 of the development cartridge D will be described.

Figure 8:
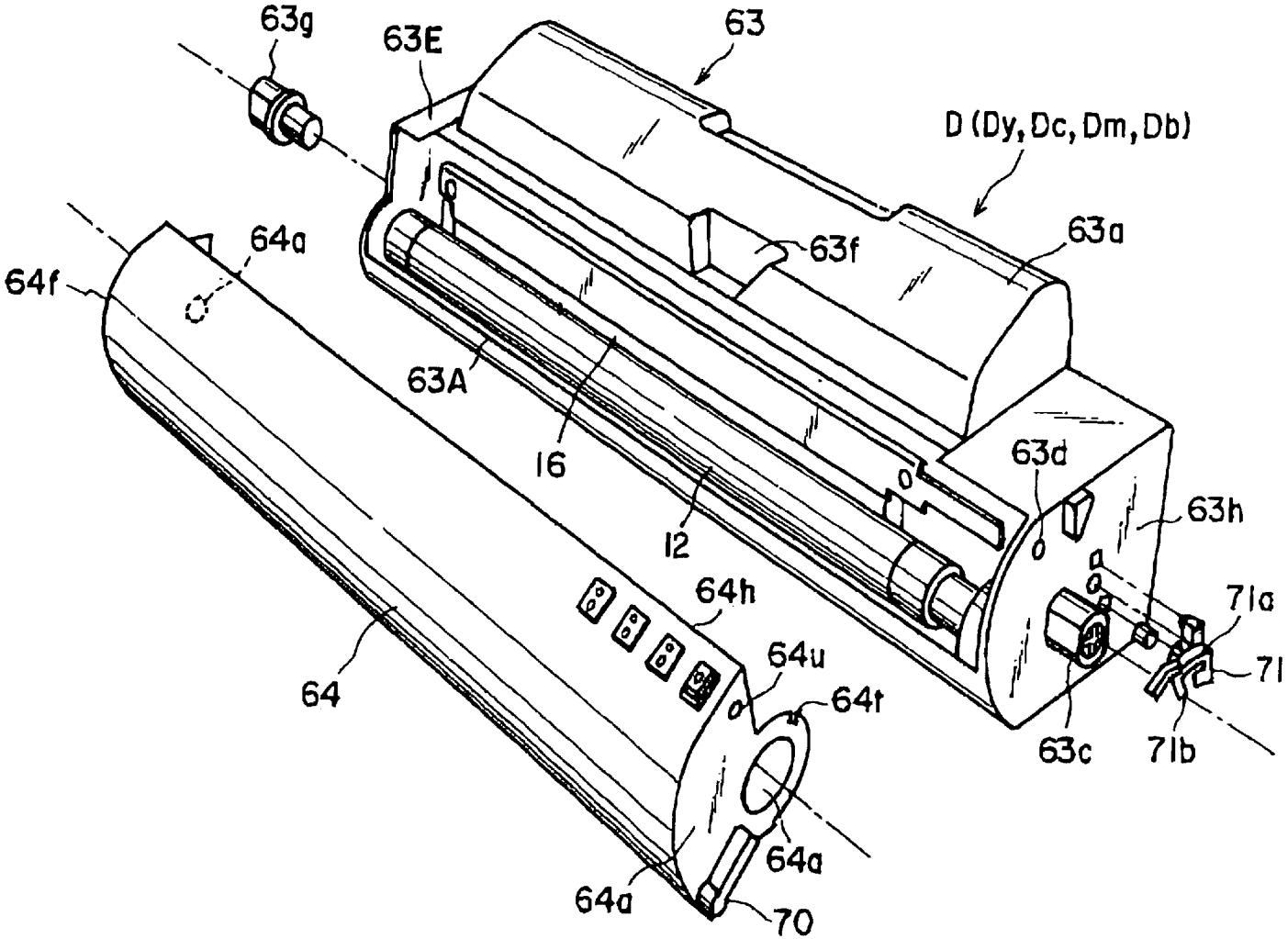
FIG. 8 is a partly exploded perspective view of a developing cartridge.

Referring to FIG. 8, both side walls 64*e* and 64*f* of the shutter 64 in terms of the lengthwise direction of the shutter 64 are provided with a round hole 64*a*, into which the projections 63*c* and 63*g* projecting, one for one, from the side walls of the developing means holding frame 63 in terms of its lengthwise direction, are fitted to rotationally support the shutter 64 by the cartridge frame 63. Next, referring to FIGS. 6 and 7, the shutter 64 is enabled to take the covering position at which it covers the development roller 12, or the retracted position at which it exposes the development roller 12. When the development cartridge D is out of the printer main assembly 30, the shutter 64 remains closed. Therefore, when the development cartridge D has never been used, it does not occur that dust and the like adheres to the development roller 12, or that the development roller 12 is damaged.

The cartridge frame 63 is provided with a locking member 71 for keeping the shutter 64 locked in the closed state in the adjacencies of the projection 63*c*. The locking member 71 comprises an elastic arm portion 71*a* and an engaging portion 71*b*. On the other hand, one of the side walls 64*e* of the shutter 64, on the same side as the locking member 71, is provided with a recess 64*t*, which is located at a predetermined position, and with which the engaging portion 71*b* engages. Thus, when the shutter 64 is in the closed state, the engaging portion 71*b* remains engaged in the recess 64*t*, keeping the shutter 64 locked in the closed state to prevent the shutter 64 from accidentally opening.

As the development cartridge D is inserted into the printer main assembly 30, the lock is automatically released to allow the shutter 64 to be opened.

Further, the side walls 64*e* of the shutter 64 are provided with a round hole 64*u*, and the side walls 63*h* of the development unit are provided with a semispherical projection 63*d*, the position of which corresponds to that of the round hole 64*u*. Thus, when the shutter 64 is in the closed state, the semispherical projections 63*d* remain engaged in the corresponding round holes 64*u*, and therefore, even after the shutter 64 is unlocked as described above, the positional relationship between the shutter 64 and development cartridge D in terms of the rotational direction of the shutter 64 does not become unstable.

[Automatic Toner Seal Member Opening Apparatus]

Next, referring to FIGS. 9–12, the structure of an embodiment of an automatic mechanism for opening a toner seal, in accordance with the present invention, will be described in detail.

The drive control means permits drive transmission from the driving means to the common seal winding shaft by the insertion of the developing cartridge D into the main assembly 30 of the image forming apparatus. Then, when the winding shaft rotates through a predetermined number of turns, the drive transmission is stopped.

When the process cartridge is inserted into the main assembly, a slide gear 65 is abutted to a projection 30*b* and slides through a predetermined distance to be brought into engagement with a gear 12*d*, by which the winding shaft can receive the driving force through the swingable unit 66 and the gear 43*b*.

Then, the winding shaft rotates through a predetermined number of turns, so that the toner sealing member is wound up, the cam portion 67*c* having a Geneva mechanism 67 releases engagement between the gear 66*b*2 and 43*b*2, so that the drive transmission to the winding shaft is released.

Figure 9:
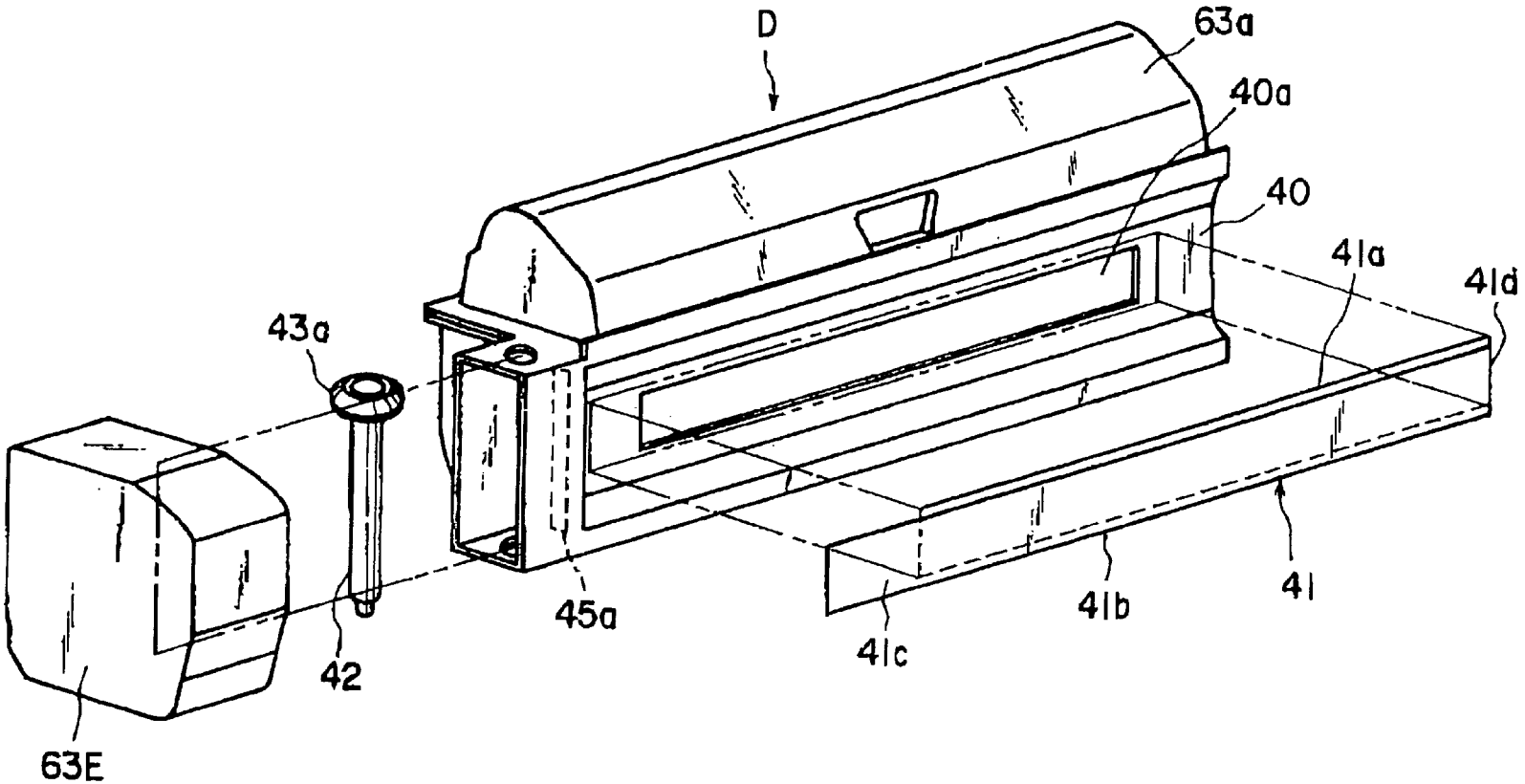
FIG. 9 is an exploded perspective view of a neighborhood of a developing cartridge.
Figure 10:
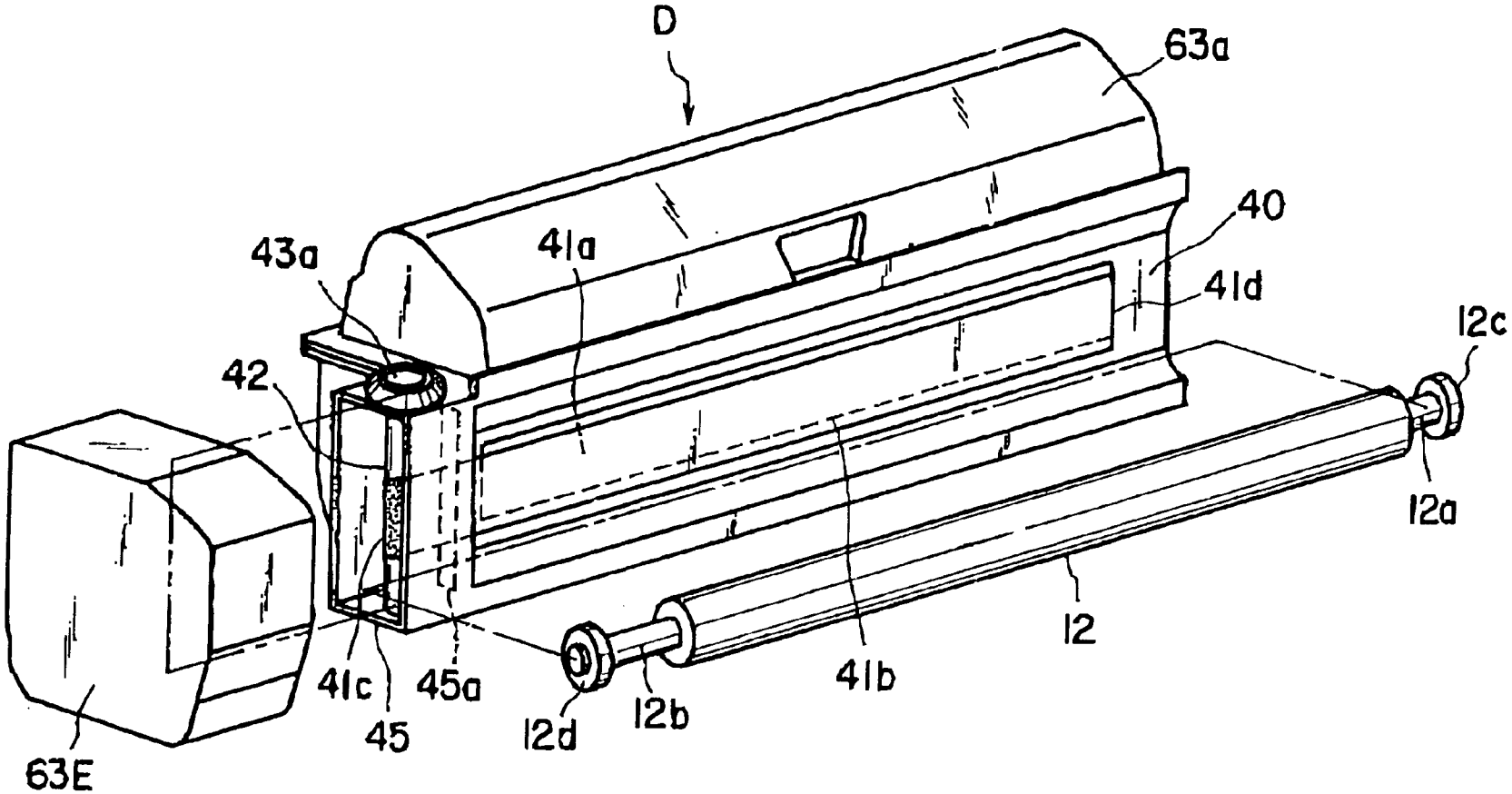
FIG. 10 is a perspective view of a toner container to which a toner seal member is affixed.

The frame of the development cartridge D comprises a toner container portion 63*a* in which toner is stored, and a developing means holding portion 63A, as shown in FIGS. 4, 9 and 10. The wall 40 of the toner container portion 63*a*, on the developing means holding portion 63A side, is provided with a toner supplying opening 40*a*, along the fringe of which the toner sealing member 41 is peelably pasted with the use of thermal welding or the like, to keep the toner sealed within the toner container portion 63*a* to prevent the toner from scattering while the development cartridge D is delivered to a user, that is, during the transportation of the development cartridge D. In this embodiment, the toner sealing member 41 is formed of flexible sheet. FIGS. 9 and 10 show the structure of toner sealing means in accordance with the present invention. The length of the toner sealing member 41 is more than twice the measurement of the aforementioned opening 40*a* in terms of the lengthwise direction of the opening 40*a*. The toner sealing member 41 comprises: a sealing portion 41*a* peelably attached to the fringe of the opening 40*a* in a manner to seal the opening 40*a* by such a means as thermal welding, and a doubling portion 41*b* which is continuous with one end of the sealing portion 41*b*. The doubling portion 41*b* is folded back at a double back point 41*b* in the adjacencies of the end of the opening 41*a*, in terms of its length direction, at which the two portions are continuous. It is doubled back on the sealing portion 41*a*, to the other end of the opening 41*a*. The end portion 41*c* of the doubling portion 41*b*, which is not continuous with the sealing portion 41*a*, is fixed to a winding shaft 42 with the use of adhesive or the like. The winding shaft 42 is enabled to be rotated about a rotational axis perpendicular to the axial line of the development roller 12, being rotationally supported by the toner container portion 63*a*. One end of the winding shaft 42 is provided with a first bevel gear 43*a* for rotating the winding shaft 42, which is an integral part of the winding shaft 42.

The flange 12*b* of the development roller 12, on the winding shaft 42 side, is provided with the development roller gear B12*d*, which is firmly fixed thereto, and is used for transmitting the driving force inputted from the printer main assembly, which will be described later, to the winding shaft 42. The development roller gear B12*d* and winding shaft 42 are connected to each other through a gear train provided on the side holder 63E, which will be described later.

Figure 11:
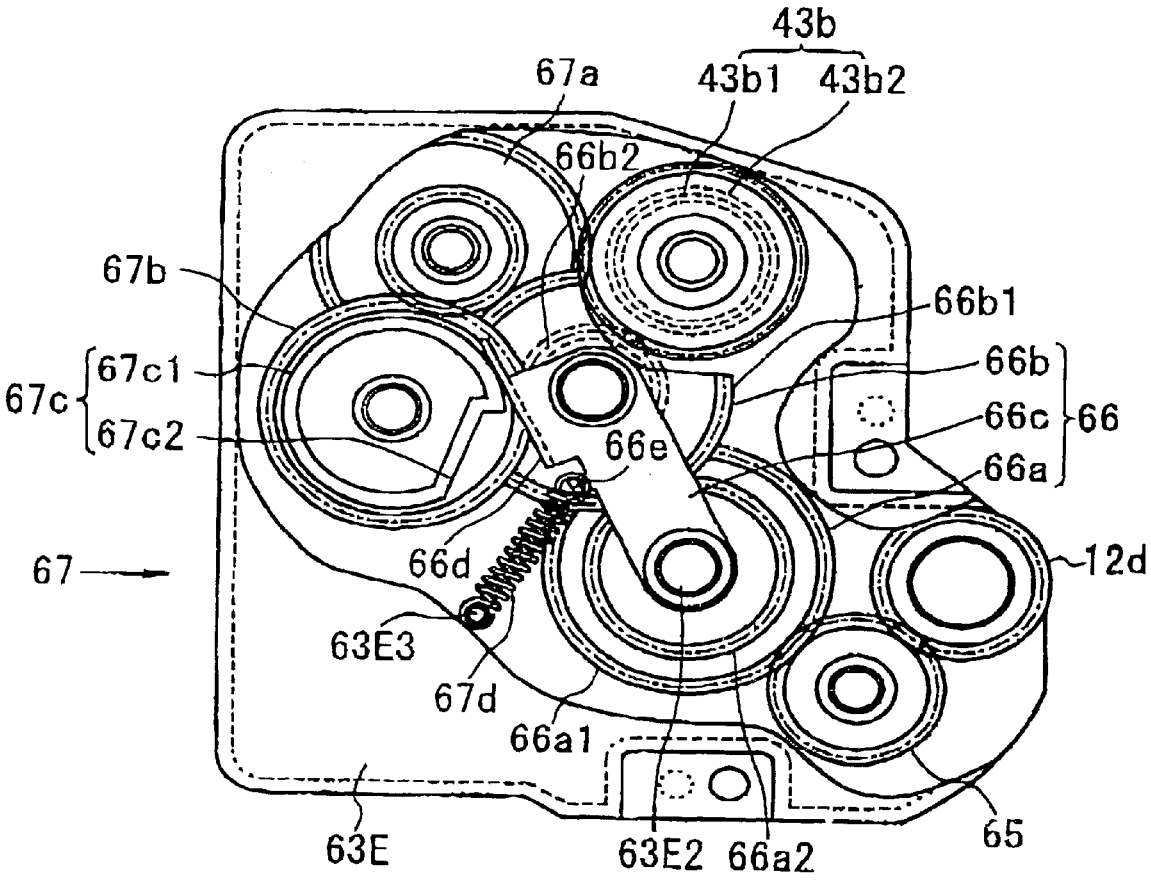
FIG. 11 is a front view of an automatic toner seal removing mechanism.

As shown in FIG. 11, the swing gear unit 66 includes swing gears 66*a* and 66*b*. The swing gears A66*a*, B66*b* are two-speed gear, and a large gear 66*a*1 of the swing gear A66*a* is in meshing engagement with an idler gear 65. The small gear 66*a*2 of the swing gear A66*a* is in meshing engagement with the swing gear B66*a*. The small gear 66*a*2 of the swing gear B66*a* and the large gear 66*b*1 of the swing gear B66*a* are in meshing engagement with each other. The small gear 66*b*2 of the swing gear B66*a* is in meshing engagement with a spur gear portion 63*b*2 of the second bevel gear.

Figure 13:
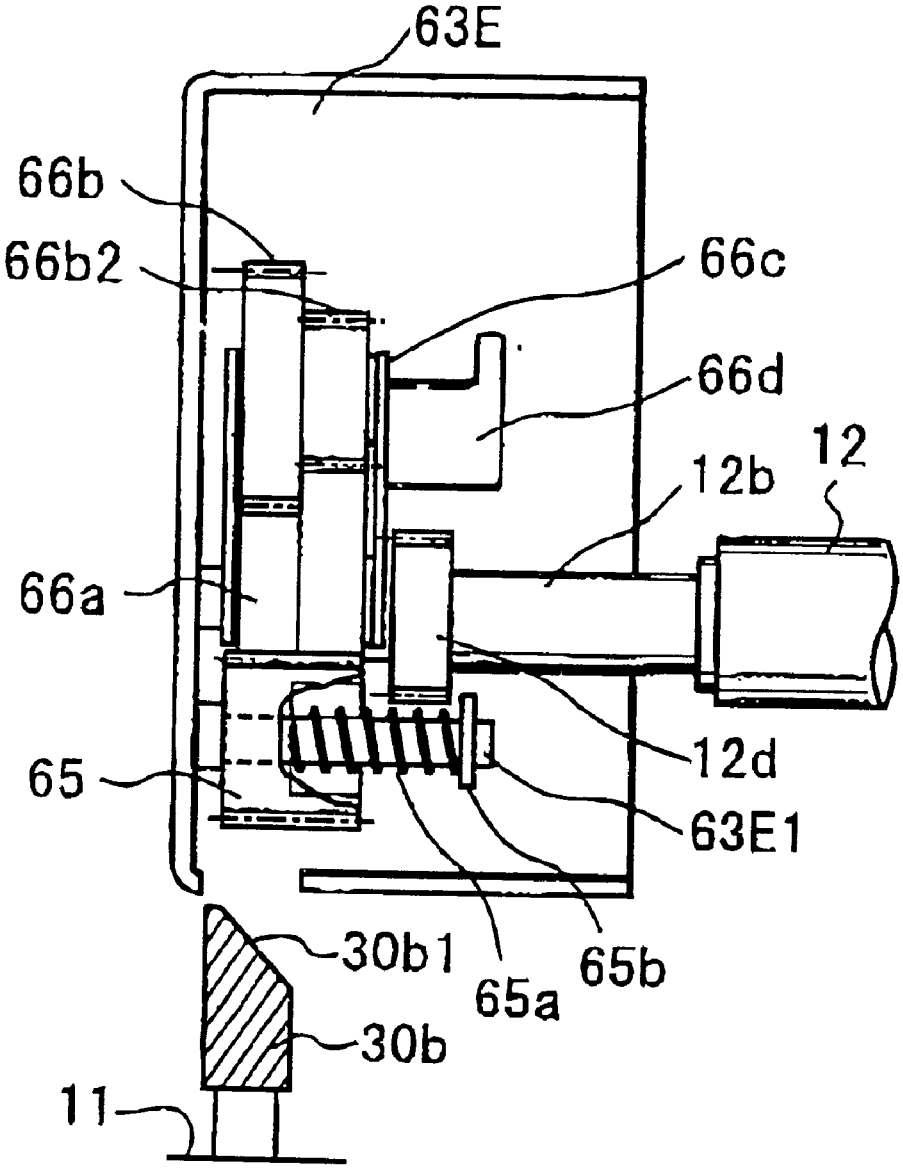
FIG. 13 is a side view of an automatic toner seal removing mechanism according to Embodiment 1 of the present invention.

FIG. 11 is an arrangement of a gear train provided on a side holder 63E. Rotatably mounted to the side holder 63E are an idler gear 65 meshed with the developing roller gear B12*d*, a swing gear unit 66 and a second bevel gear 43*b* meshed with the first bevel gear 43*a* integrally mounted to the winding-up shaft 42, which constitute a gear train. As shown in FIG. 13, the idler gear 65 is urged slidably in a longitudinally outward direction of the developing cartridge D by an input spring 65*a*. The idler gear 65 is rotatably supported by a fixed shaft 63E1 extended out of an inner wall of the side holder 65E parallel to the developing roller 12. The input spring 65*a* is inserted into the fixed shaft 63E1 and is compressed between the idler gear 65 and a stopping ring 65*b*. The stopping ring 65*b* is engaged in a circumferential group formed in the fixed shaft 63E1. The input spring 65*a* is a compression coil spring. In the state, the idler gear 65 is in meshing engagement only with the swing gear A66*a* of the swing gear unit 66, and is not in meshing engagement with the developing roller gear B12*d*. However, when it is slid through a predetermined distance in a longitudinally inward direction by an external force upon insertion into the main assembly of the image forming apparatus, as will be described hereinafter, the idler gear 65 is brought into meshing engagement with both of the swing gear unit 66 and the developing roller gear B12*d*, by which the driving force can be transmitted from the main assembly 30 of the apparatus to the winding-up shaft 42. The second bevel gear 43*b* is a stepped gear comprising a bevel gear 43*b*1 for engagement with the first bevel gear 43*a* and a spur gear portion 43*b*2. Here, the spur gear 43*b*2 is engaged with a small gear 66*b*2 of the swing gear B66*a*. The swing gear unit 66 comprises a swing gear A66*a*, a swing gear B66*b*, and a connection plate 66*c* connecting the two gears with each other. The connection plate 66*c* is swingable about a supporting shaft 63E2 of the swing gear A66*a*, which is engageable with the idler gear 65. The swing gear portion B66*b* is rotatably mounted to the end portion of a connection plate 66*c* and is swingable with the connection plate 66*c*.

Figure 12:
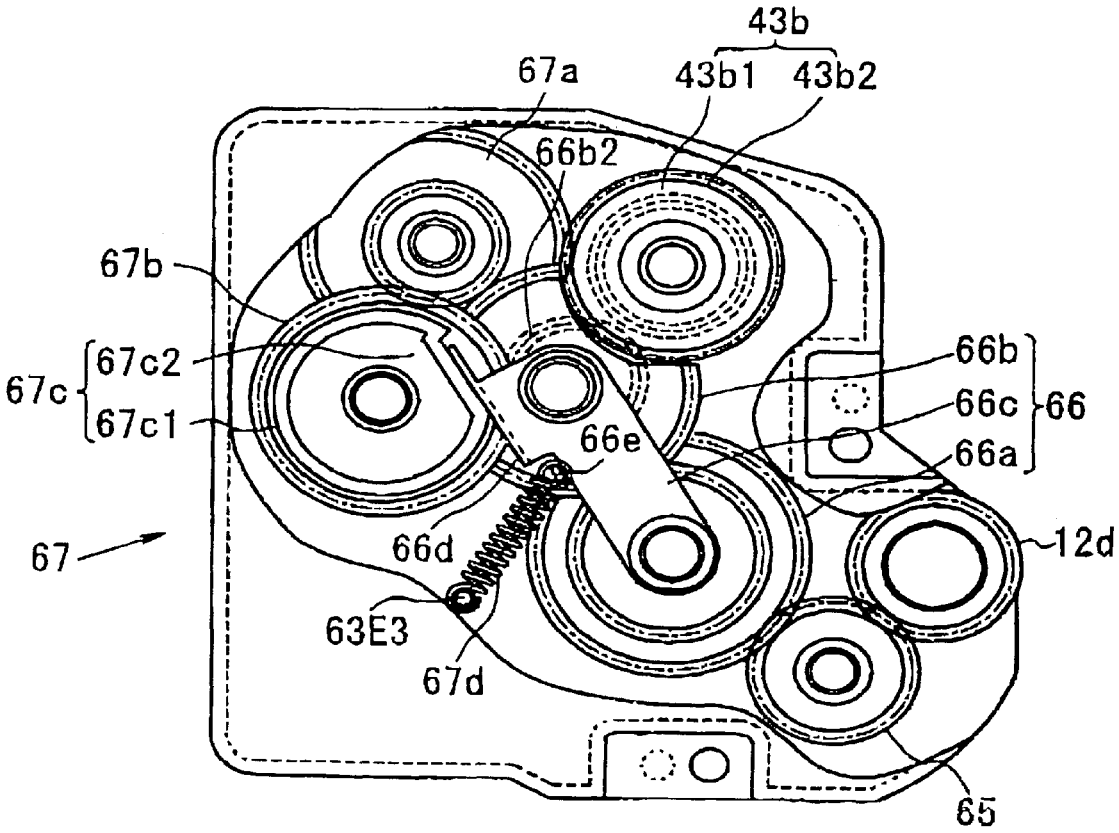
FIG. 12 is a front view of an automatic toner seal removing mechanism.

The position of the swingable swing gear unit 66 is selectively controlled by a drive control mechanism 67. The drive control mechanism 67 comprises an intermittent gear A67*a* for receiving a driving force from the spur gear portion 43*b*2 of the second bevel gear 43*b*, and an intermittent gear B67*b* intermittently rotatable by engagement with the intermittent gear A67*a*, and they are rotatably supported on the side holder 63E. The intermittent gear B67*b* is provided with a holding surface 67*c*1 and a cam portion 67*c*, which are integral with each other. The holding surface 67*c*1 assures the position for meshing engagement between the small gear 66*b*2 of the swing gear B66*b* and the spur gear portion 43*b*2 of the second bevel gear 43*b*, that is, the distance between the centers of the swing gear B66*b* and the second bevel gear 43*b*, as shown in the FIG. 11. The cam portion 67*c* is a blocking surface 67*c*2 for disengaging them from each other by increasing the distance between the centers of the swing gear B66*b* and the second bevel gear 43*b*, as shown in FIG. 12. The cam portion 67*c* is press-contacted by a lever 66*d* integrally extended from the connection plate 66*c* of the swing gear unit 66 by the function of the spring 67*d*. Therefore, the position of the swing gear B66*b* is controlled by the cam profile of the cam portion 67*c*. The spring 67*d* is a tension coil springs and is hooked at one end on a spring hook 66*e* provided on the connection plate 66*c*, and is hooked at the other end on a spring hook 63E3 provided on the side holder 63E.

In this embodiment, as shown in FIG. 10, the winding-up shaft 42 is covered with a winding-up shaft cover 45, which is integral with the toner container 63*a* or integrated by welding or the like. The winding-up shaft cover 45 is provided with a winding-up opening 45*a* through which the toner seal member 41 penetrates, and the folded back end portion 41*c* of the toner seal member 41 is fixed on the winding-up shaft 42 through the opening 45*a*.

Referring to FIGS. 11–13, a description will be provided as to the operation when the developing cartridge D is mounted to the main assembly 30 of the image forming apparatus.

FIG. 11 shows a state before the developing cartridge D is mounted to the main assembly 30 of the image forming apparatus. In the state, the lever 66*d* is contacted to the holding surface 67*c*1, which is an arcuate surface having a center that is the rotational center of the cam portion 67*c*, so that the connection plate 66*c* is urged rightward against the spring force of the spring 67*d*. Therefore, the small gear 66*b*2 is in meshing engagement with the spur gear portion 43*b*2 of the second bevel gear 43*b*, so that the driving force can be transmitted to the winding-up shaft 42. However, the idler gear 65 is urged by the input spring 65*a*, and therefore, the idler gear 65 is out of meshing engagement with the developing roller gear B12*d*, as shown in FIG. 13. Therefore, even if the driving force is applied to the developing cartridge D, it is not transmitted to the winding-up shaft 42. For this reason, even if the developing cartridge D is driven for the purpose of initial torque measurement or inspection, such as a surface damage check of the developing roller 12 after the developing cartridge D is assembled up, the idler gear 65 is not rotated although the developing roller 12 rotates. Accordingly, it can be avoided that the toner seal member 41 is wound up unintentionally.

[Automatic Removal of the Toner Seal Member]

Figure 14:
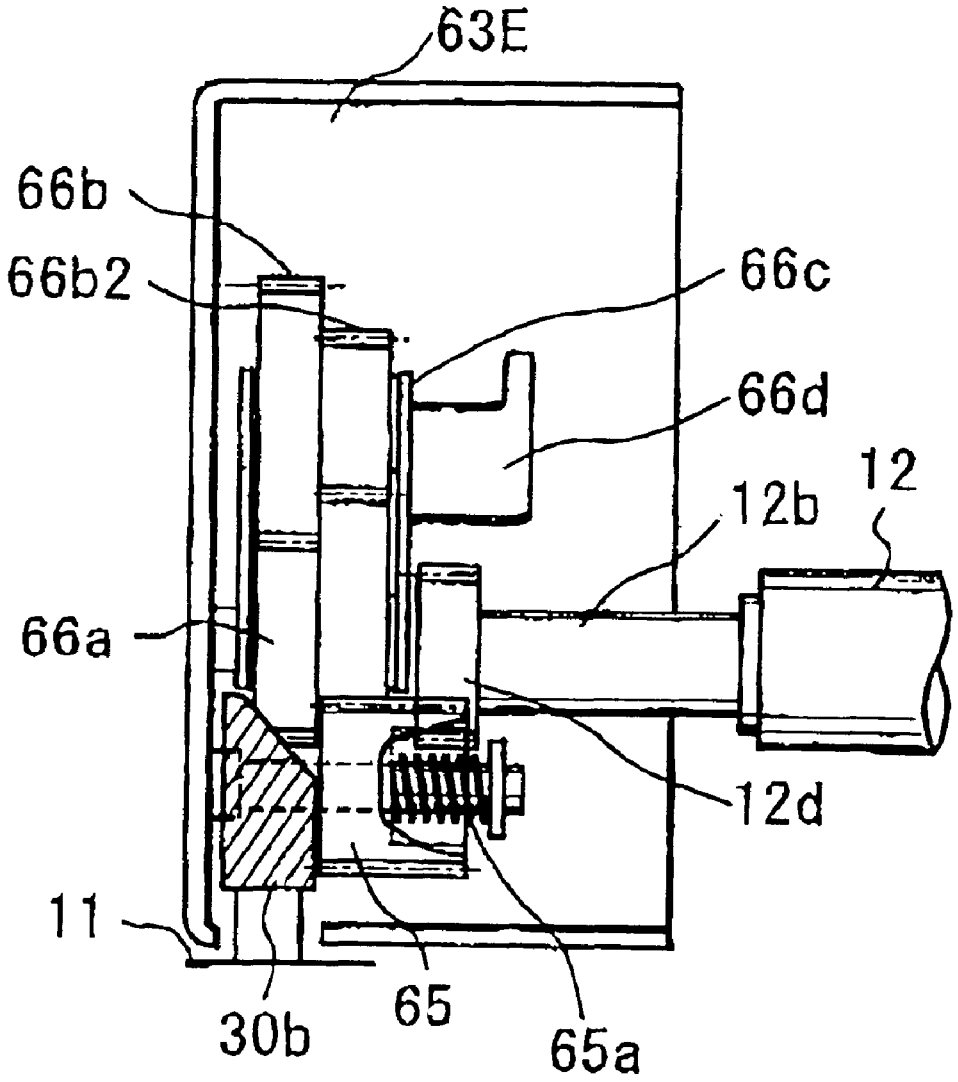
FIG. 14 is a side view of an automatic toner seal removing mechanism according to Embodiment 1 of the present invention.

When the developing cartridge D is mounted to the main assembly 30 of the image forming apparatus in place, the developing cartridge D is moved to a predetermined position. Then, as shown in FIGS. 13 and 14, a projection 30*b* provided in the rotary unit 11 in the main assembly 30 of the image forming apparatus causes the idler gear 65 in the longitudinally inward direction to move through a predetermined distance. This is effected by abutment of the inclined surface cam portion 30*b*1 of the projection 30*b* to a corner of the idler gear 65. By this, the idler gear 65 is brought into meshing engagement with the swing gear A66*a* and also with the developing roller gear B12*d*, as shown in FIG. 14, by which the driving force becomes transmittable from the main assembly 30 of the image forming apparatus. Simultaneously, the driving force is transmitted from a driving gear (unshown) of the main assembly 30 of the image forming apparatus to a driven input gear (unshown) provided at an end surface of the toner container 63*a* which is opposite from the end at which the winding-up shaft 42 is provided. The driven input gear is in meshing engagement with the developing roller gear A12*c* mounted to a flange 12*a* at the end opposite from the end having the winding-up shaft 42, so that developing roller 12 is rotated thereby. In this manner, the developing roller gear B12*d* fixed on the flange 12*b* which is in turn fixed on the developing roller 12, is rotated. Thus, the driving force is transmitted from the developing roller gear B12*d* to the winding-up shaft 42 through the gear train, and more particularly through the idler gear 65, the swing gear A66*a*, the swing gear B66*b*, the second bevel gear 43*b*, and first bevel gear 43*a*.

The toner seal member 41 which seals the opening 40*a* as shown in FIG. 10 is gradually wound up on the winding-up shaft 42. When the toner seal member 41 is completely wound up by the winding-up shaft 42, the toner is supplied to the developing roller 12 through the opening 40*a*.

Figure 15:
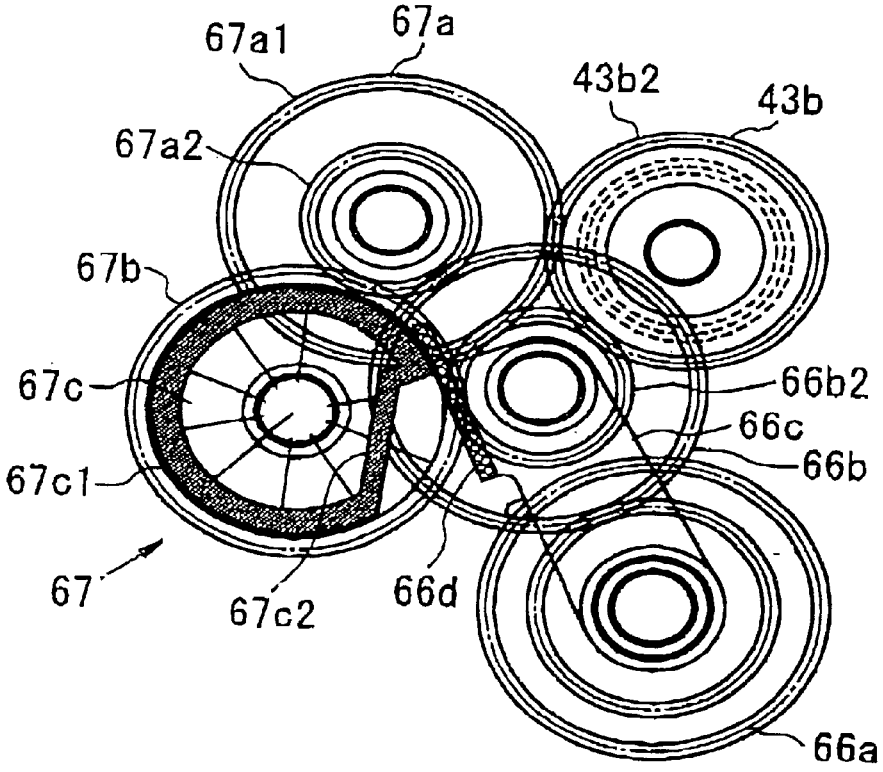
FIG. 15 is a front view illustrating a function of an automatic toner seal removing mechanism.
Figure 16:
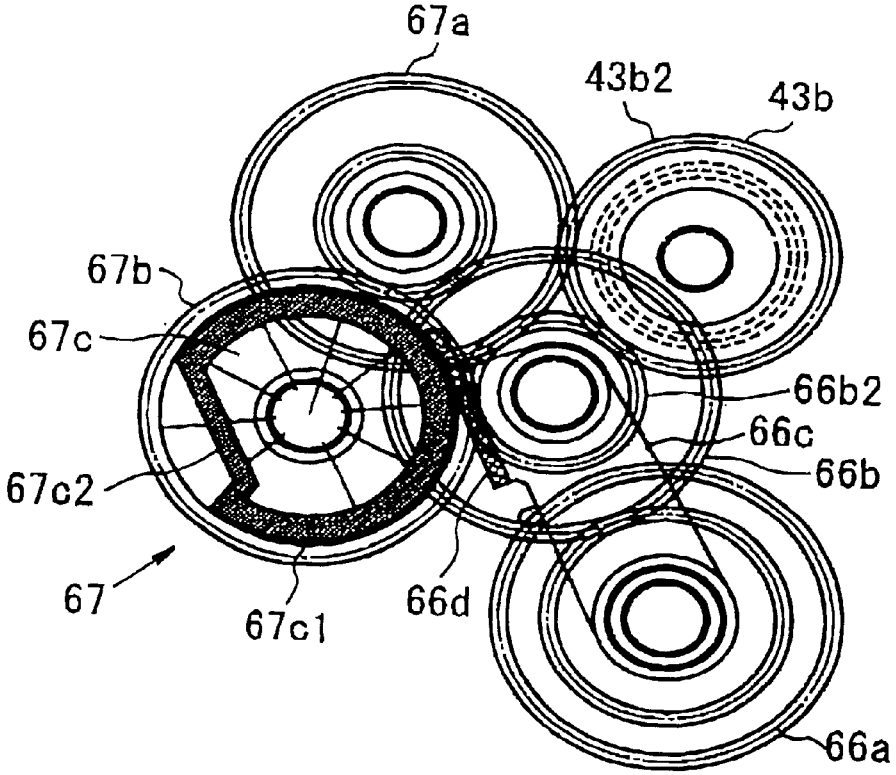
FIG. 16 is a front view illustrating a function of an automatic toner seal removing mechanism.

Referring to FIGS. 15–18, a description will be provided as to the stop of driving of the winding up shaft 42 of the drive control mechanism 67. As described in the foregoing, before the developing cartridge D is mounted to the main assembly 30 of the image forming apparatus, the lever 66*d* integrally extended from the connection plate 66*c* of the swing gear unit 66 contacts the holding surface 67*c*1 of the cam portion 67*c* of the intermittent gear B67*b*. Therefore, the small gear 66*b*2 of the swing gear B66*b* is in meshing engagement with the spur gear portion 43*b*2 of the second bevel gear 43*b* (FIG. 15). When the driving force is transmitted from the driving gear of the main assembly 30 of the image forming apparatus through the developing roller gear A12*c* and so on, the intermittent gear A67*a* is rotated by the meshing engagement between the small gear 66*b*2 of the swing gear B66*b* and the large gear 67*a*1 of the intermittent gear A67*a*. The intermittent gear A67*a* rotates the intermittent gear B67*b*. Here, the intermittent gear A67*a* has an integral driving wheel 67*a*2 of a Geneva ear mechanism, and the intermittent gear B67*b* is a driven wheel of the Geneva ear mechanism. In the figure, it is indicated in the form of a gear for simplicity. The intermittent gear B67*b* is engaged by one tooth with one rotation of the intermittent gear A67*a* to effect intermittent motion through a predetermined rotational angle.

Thus, when the intermittent gear B67*b* has n teeth, the intermittent gear B67*b* rotates through one full turn upon n rotations of the intermittent gear A67*a*.

Figure 17:
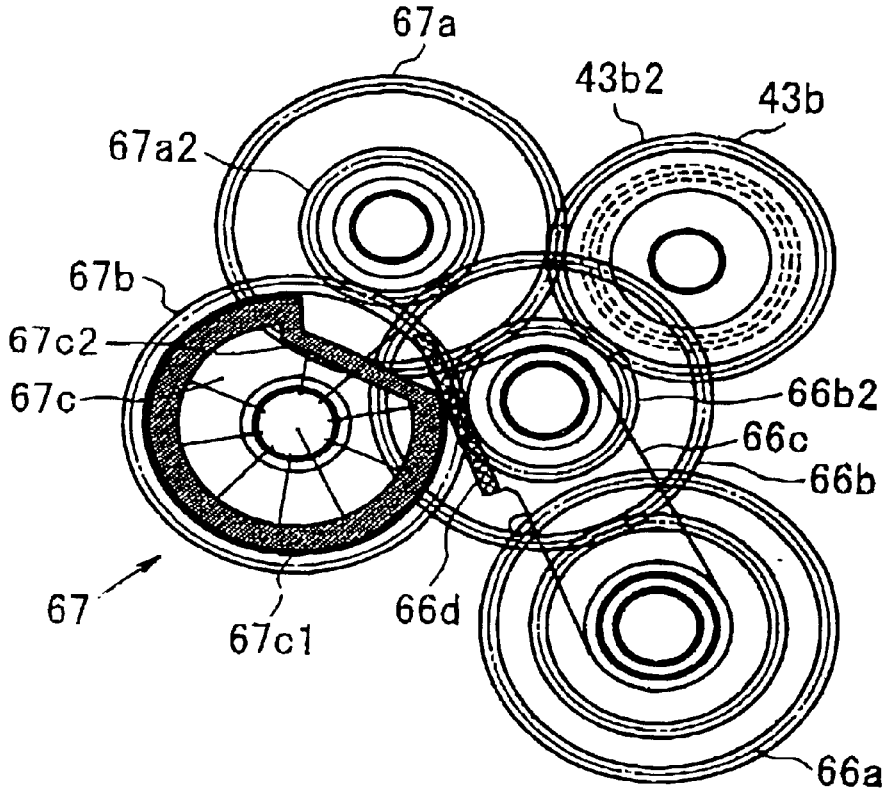
FIG. 17 is a front view illustrating a function of an automatic toner seal removing mechanism.
Figure 18:
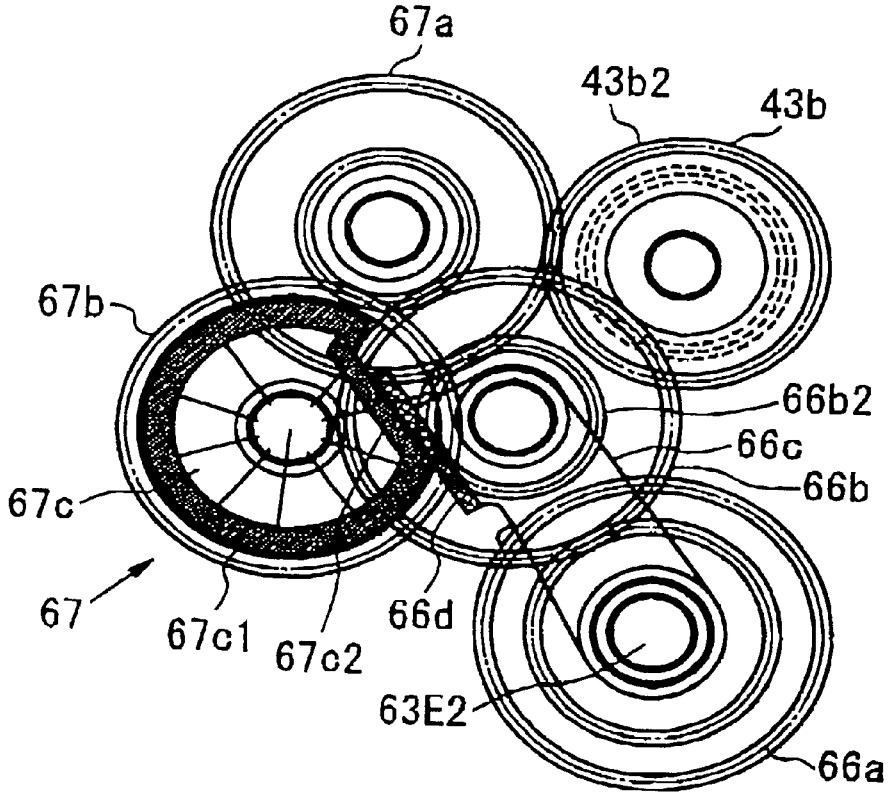
FIG. 18 is a front view illustrating a function of an automatic toner seal removing mechanism.

The speed of the intermittent gear B67*b* is sufficiently reduced relative to the speed of the winding-up shaft 42 so that engagement of the swing gear unit 66 is maintained by the holding surface 67*c*1 of the cam portion 67*c* of the intermittent gear B67*b*, and therefore, the rotational drive for the winding-up shaft 42 is maintained (FIGS. 16–17) before the toner seal member 41 is wound up. As shown in FIG. 17, the intermittent gear B67*b* temporarily stops while maintaining the contact at the holding surface 67*c*1, adjacent the boundary between the holding surface 67*c*1 and the blocking surface 67*c*2. When the winding-up shaft 42 rotates through such an extent that the toner seal member 41 is sufficiently wound up, the driving wheel 67*a*2 of the Geneva gear mechanism rotates the intermittent gear B67*b*, and the blocking surface 67*c*2 faces the lever 66*d* as shown in FIG. 18. The lever 66*d* is attracted by the spring force of the spring 67*d* by which the connection plate 66*c* is rotated in the counterclockwise direction about the supporting shaft 63E2. By this, the swing gear B66*b* swings to a position where the engagement between the second bevel gear 43*b* and the spur gear portion 43*b*2 is released, so that the driving of the second bevel gear 43*b* to the upstream side is stopped, that is, the winding-up shaft 42, the intermittent gear A67*a*, and the intermittent gear B67*b* are no longer driven (FIG. 18). When the driving to the intermittent gear B67*b* is stopped, the engagement between the swing gear B66*b* and spur gear portion 43*b*2 of the second bevel gear 43*b* is maintained disengaged, and therefore the winding-up shaft 42 is not driven again. Therefore, after the toner seal member 41 is wound up, the winding-up shaft 42 is not driven more than necessary, and therefore, the possible toner scattering, and the noise or the like due to the flappering of the toner seal member 41 can be prevented, and in addition, the load on the driving motor of the main assembly of the image forming apparatus can be saved after the completion of the winding-up operation of the toner seal member 41.

In this embodiment, the drive transmission and the driving direction change for the winding-up shaft 42 is effected by means of the bevel gear. However, the present invention is not limited to this example, and they may be effected by means of a warm gear or the like.

In this embodiment, the process cartridge and the developing cartridge are detachably mountable, respectively. However, the present invention is applicable to a process cartridge containing as a unit developing means and a photosensitive drum, and is detachably mountable to the main assembly of the image forming apparatus, and also in applicable to a toner supply container alone.

In the foregoing, the Geneva gear mechanism is provided between the intermittent gears A67*a* B67*b*, but another intermittent gear mechanism is usable. If such a cam profile is used such that when the lever 66*d* is disengaged from the holding surface 67*c*1 of the cam portion 67*c*, the lever 66*d* quickly displaces to the cam lift 0 position, a normal gear rather than the intermittent gear may be used with a high reduction ratio.

Embodiment 2

Figure 19:
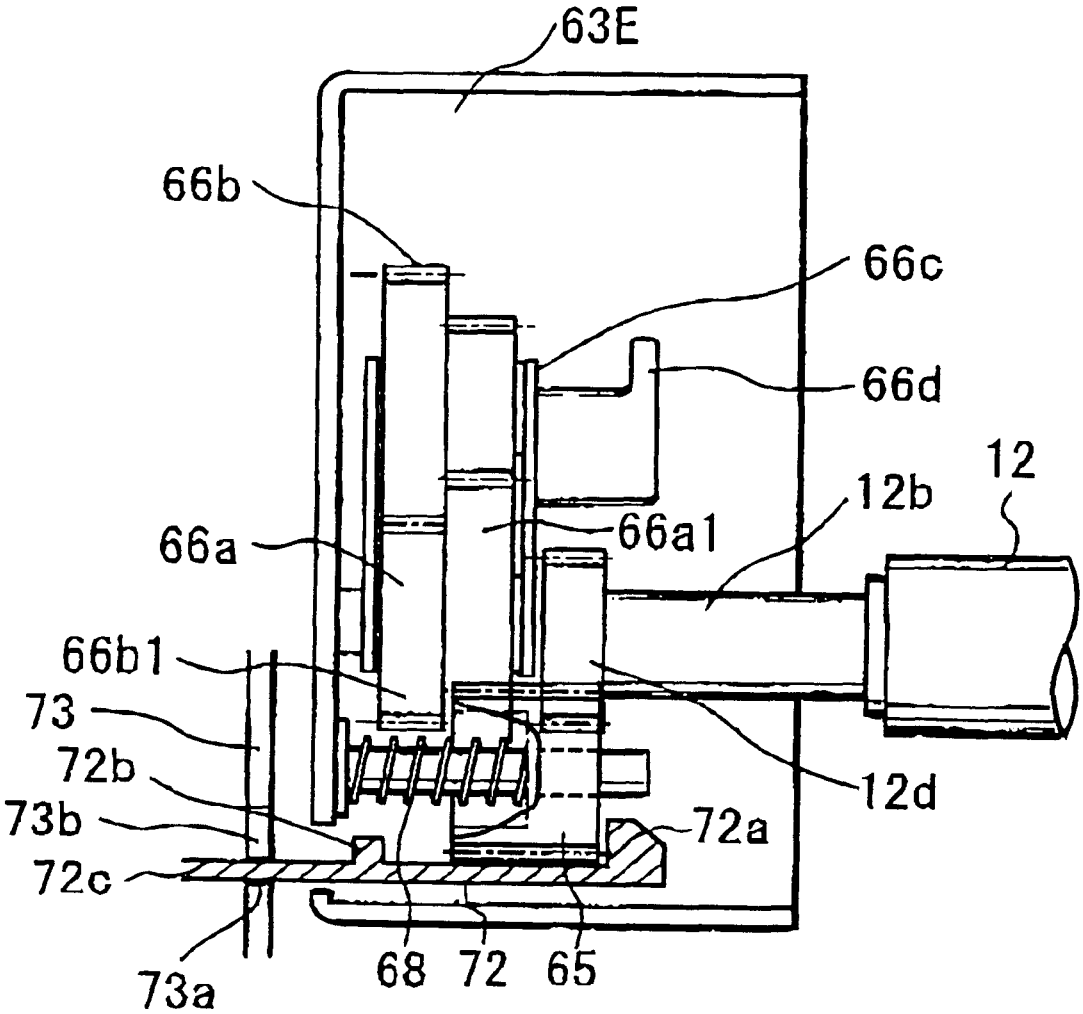
FIG. 19 is a side view of an automatic toner seal removing mechanism according to Embodiment 1 of the present invention.
Figure 20:
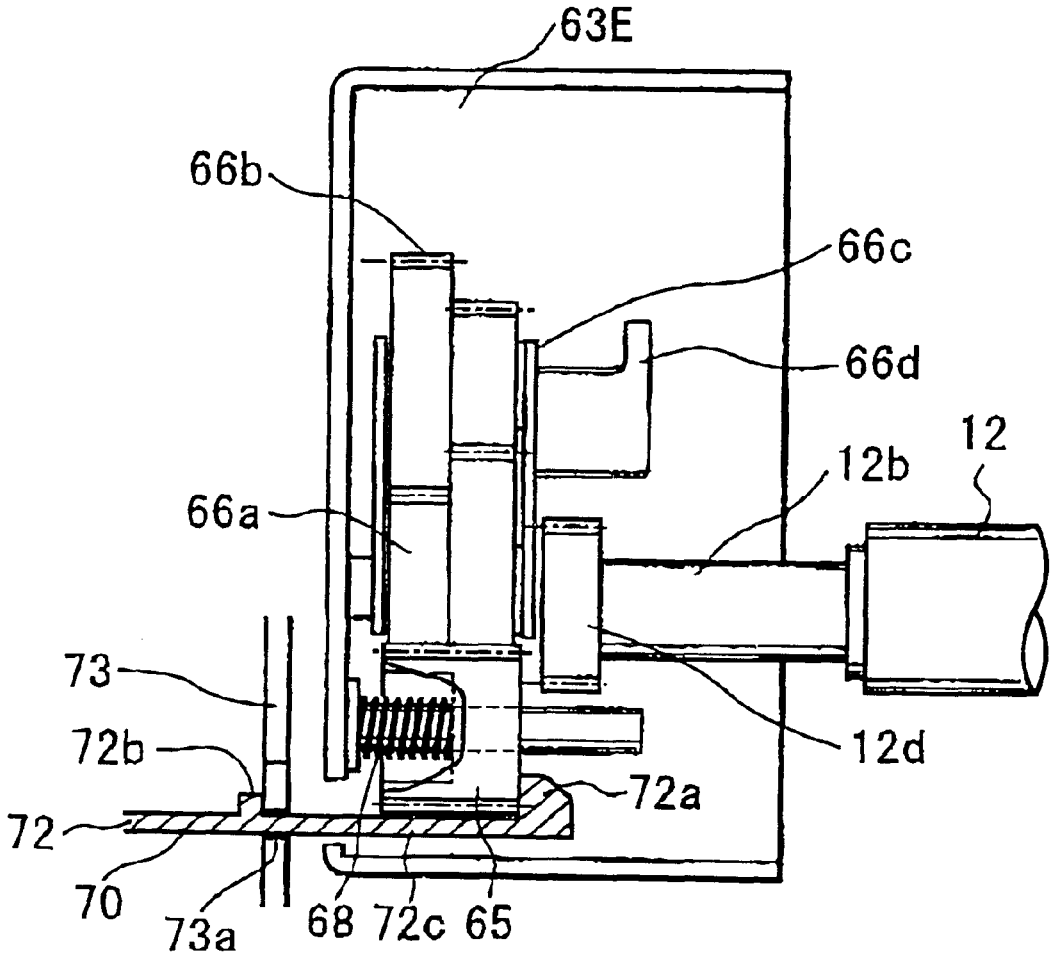
FIG. 20 is a side view of an automatic toner seal removing mechanism according to Embodiment 1 of the present invention.

Referring to FIG. 19, a description will be provided as to Embodiment 2.

The same reference numerals as seen the first embodiment are assigned to the elements having the corresponding functions, and a detailed description thereof is limited for simplicity.

In the foregoing embodiment, by the movement of the developing cartridge D to the predetermined position when the developing cartridge D is mounted to the main assembly 30 of the image forming apparatus, the projection 30*b* provided in the main assembly 30 of the image forming apparatus causes the idler gear 65 to slide through a predetermined distance, which brings the idler gear 65 into meshing engagement with the swing gear A66*a* and the developing roller gear B12*d* to establish the driving force transmittable state for the winding-up shaft 42.

In Embodiment 2, the driving force is transmittable to the winding-up shaft 42 during normal use, and the driving is not permitted during the inspection in the process of assembling the developing cartridge D.

FIG. 19 shows the state before the developing cartridge D is mounted to the main assembly 30 of the image forming apparatus, in which the swing gear B66*b* is in meshing engagement with the spur gear portion 43*b*2 of the second bevel gear 43*b*, and the idler gear 65 is urged by the spring 68 to a position for engagement with the large gear 66*a*1 of the swing gear A66*a* and the developing roller gear B12*d*. Therefore, with the state, the driving force can be transmitted to the winding-up shaft 42. In normal use, when the driving force is supplied from the driving gear 30*a*, when the developing cartridge D having the structure described above is mounted in place in the main assembly 30 of the image forming apparatus, the winding-up shaft 42 is rotated through the gear train, so that the toner seal member is wound up.

On the other hand, in the inspecting operation in the plant, when the driving force is applied to the developing cartridge D, a claw 72 of an inspection tool causes the idler gear 65 against the spring 68 in the longitudinally outward direction to move through a predetermined distance when the developing cartridge D is mounted. By this, the idler gear 65 and the developing roller gear B12*d* are disengaged from each other. The claw 72 has a round shaft portion 72*c*, which is provided with a claw portion 72*a* contactable to a side of the idler gear 65, a locking projection 72*b*, and a shaft portion 70*c*, which is rotatable within a limit relative to the hole 73*a*.

When the developing cartridge D is set on a step inspecting apparatus 73, the claw 72 is inserted into the hole 73*a* as shown in FIG. 19. The hole 73*b* is provided with a cut-away portion 73*b* (in the radially outward direction) for permitting the claw portion 72*a* and the locking projection 72*b* to pass. The thicknesses of the claw portion 72*a* and the locking projection 12*b* are smaller than the diameter of the shaft portion 72*c*. The claw 72 makes this movement leftwardly against the spring force of the spring 68 to cause the locking projection 72*b* to pass the cut away portion 73*b* at the edge of the hole 71*a*, and then the shaft portion 72*c* is rotated slightly to place the locking projection 72*b* out of alignment with the cutaway portion 73*b*. By doing so, the idler gear 65 is brought out of engagement with the developing roller gear B12*d*, and the disengaged state is maintained.

Accordingly, even if the driving force is applied to the developing cartridge D, the driving force is not transmitted to the winding-up shaft 42. In this manner, the driving force is applied to the developing cartridge D for the purpose of an inspecting operation for initial tongue measurement or for a surface damage check of the developing roller 12, the toner seal member 41 is not unintentionally wound up.

Embodiment 3

A description will be provided as to Embodiment 3.

First, the general arrangements of the image forming apparatus and the process cartridge, and then an automatic seal removing device, will be described.

(General Arrangement)

Figure 22:
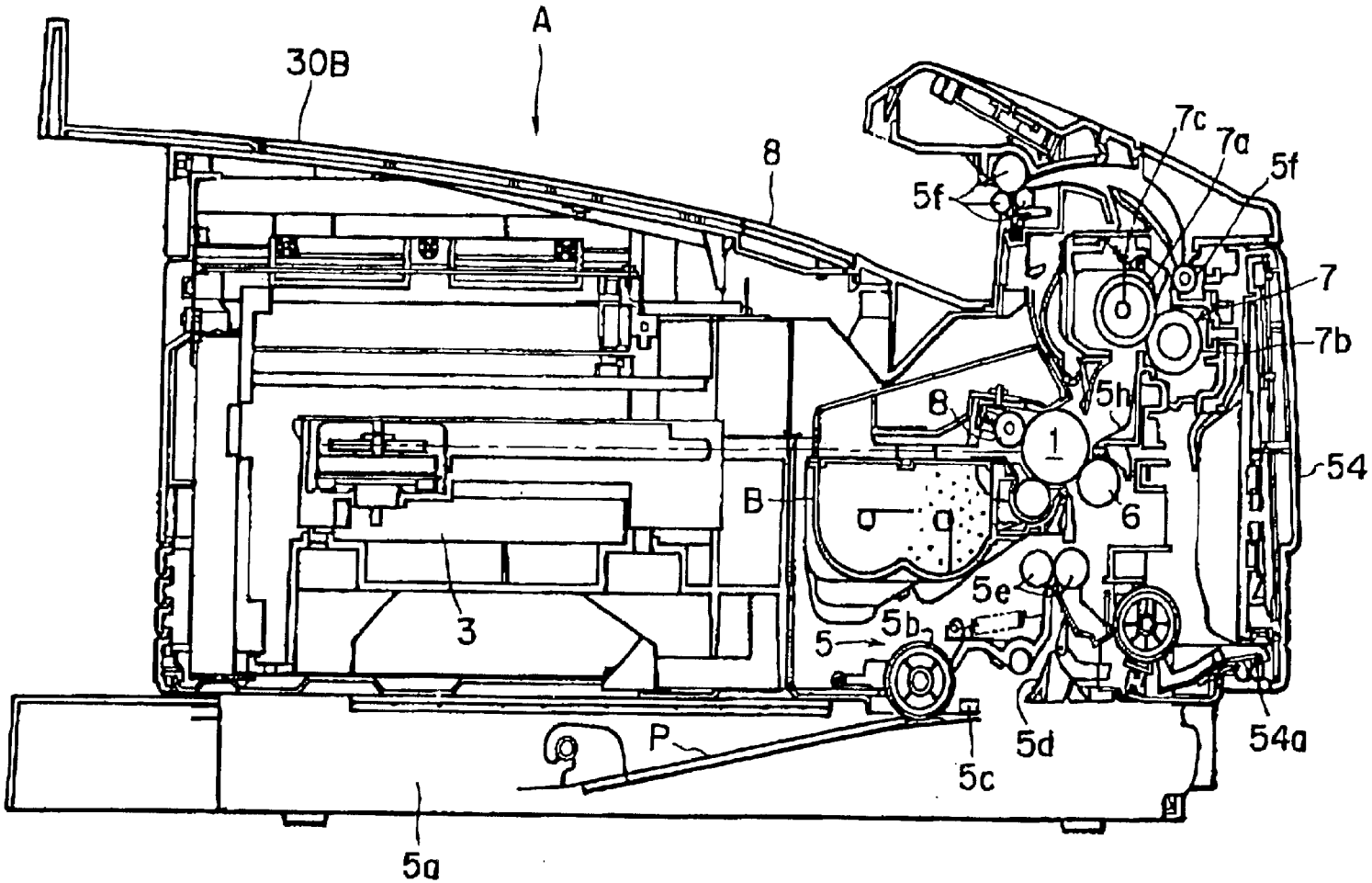
FIG. 22 is a longitudinal sectional view of an electrophotographic image forming apparatus with which the Embodiment 3 is usable.

As shown in FIG. 22, in the electrophotographic image forming apparatus (laser beam printer) A, information light modulated in accordance with image information is projected from a scanner portion 3 onto an electrophotographic photosensitive member in the form of a drum so that and an electrostatic latent image is formed on the photosensitive member, and the latent image is developed into a toner image. In synchronism with formation of the toner image, a transfer material P (recording material) is fed in seriatim out of a sheet cassette 5*a* by cooperation of a sheet feeding roller 5*b* and a separation claw 5*c* press-contacted to the top surface of the recording materials to the corner portions. The transfer material P is fed by feeding means 5 including a guiding plate 5*d* and registration rollers 5*e* and so on. The toner image formed on the electrophotographic photosensitive member in a process cartridge B is transferred onto the transfer material by voltage application to the transferring means in the form of a transfer roller 6, and the transfer material is fed to a fixing portion 7 along a feeding path 5*h*. The fixing portion 7 comprises a pressing roller 7*b* and a fixing roller 7*a* containing therein a heater 7*c*, and applies heat and pressure to the recording material passing through a nip formed therebetween surface to fix the transferred toner image. The recording material is discharged by discharging rollers 5*f* to a discharging portion 8 through a reverse feeding path.

Figure 21:
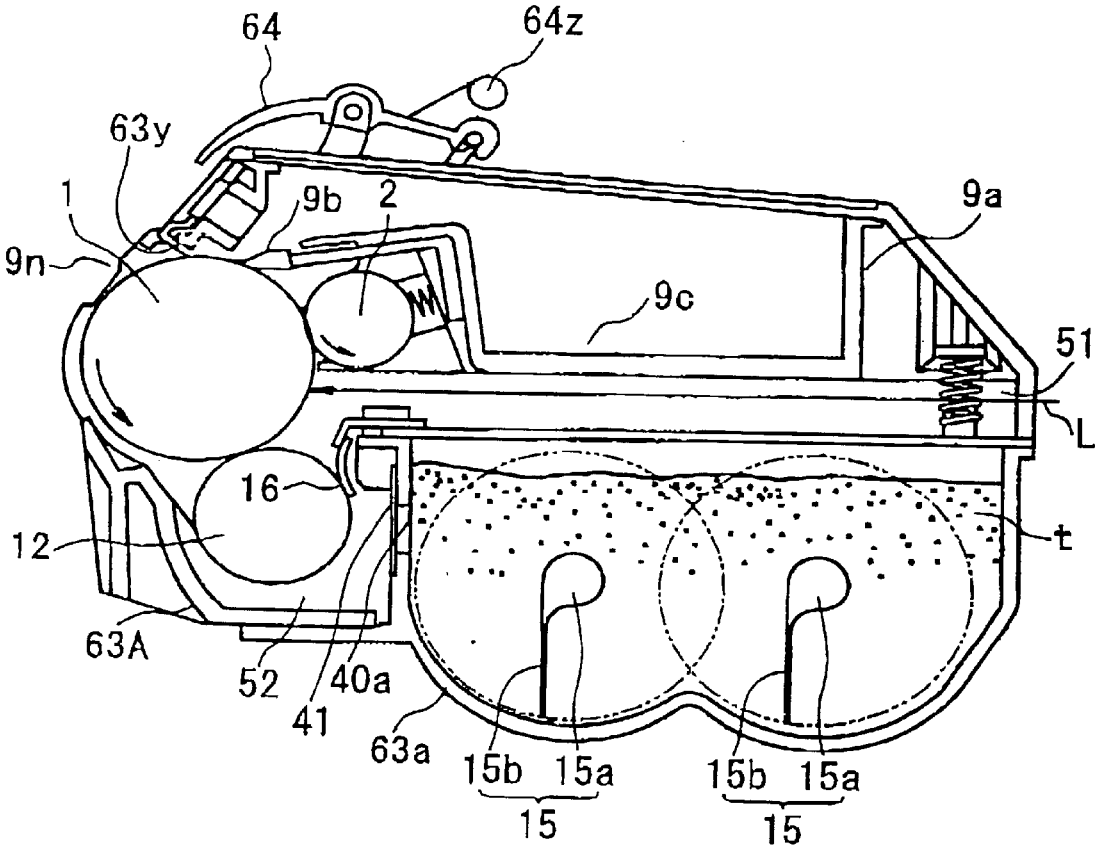
FIG. 21 is a longitudinal sectional view of a process cartridge according to Embodiments 3 of the present invention.

On the other hand, the process cartridge B contains the electrophotographic photosensitive member and at least one process means. Here, the process means includes charging means for electrically charging the electrophotographic photosensitive member, developing means for developing a latent image formed on the electrophotographic photosensitive member, cleaning means for removing the toner remaining on a surface of the electrophotographic photosensitive member, for example. As shown in FIG. 21, in the process cartridge B of this embodiment, the electrophotographic photosensitive member in the form of a photosensitive drum 1 having a photosensitive layer is rotated, during which the charging means 2 in the form of a charging roller is supplied with a charging voltage to uniformly charge the surface of the photosensitive drum 1. The light image is projected from the scanner portion 3 onto the charged surface of the photosensitive drum 1 through an exposure opening 51, so that a latent image is formed. Then, the latent image is developed by a developing zone 52 (developing means).

In the developing zone 52, the toner is fed out of the toner container 63*a* through the opening 40*a* by a toner feeding mechanism 15 (toner feeding means) which is rotatable and provided in a toner accommodating portion. A developing roller 12 (developing member) enclosing a fixed magnet is rotated by which a layer of toner triboelectrically charged by a developing blade 16 is formed on the surface of the developing roller 12. The toner in the toner layer is transferred onto the photosensitive drum 1 in accordance with the latent image so that visualized toner image is formed. The toner feeding mechanism 15 comprises a shaft 15*a* and a stirring blade 15*b*. The shaft 15*a* is rotatably supported on the toner container 63*a*, and one end thereof is extended out of the container 63*a*. When the process cartridge B is a fresh one, the opening 40*a* is sealed with a toner seal member 41, and the toner does not leak out from the toner container 63*a*. The toner seal member 41 is removed by an automatic unsealing mechanism.

After the toner image is transferred onto the recording material by the application of a voltage of the polarity opposite from that of the toner image to the transfer roller 6, the residual toner remaining on the photosensitive drum 1 is scrapped off by a cleaning blade 9*b*, and the removed toner is received by a receptor sheet 63*y* and is collected into a removed toner accommodating portion 9*c* of the cleaner container 9*a*. Thus, the residual toner is removed from the photosensitive drum 1 by the cleaning means.

(Cartridge Mounting Means)

The photosensitive drum 1 and so on are contained as a unit in a cartridge frame comprising a toner container 63*a* and a cleaner container 9*a*, and are mounted as a unit to the main assembly 30B of the cartridge.

Figure 23:
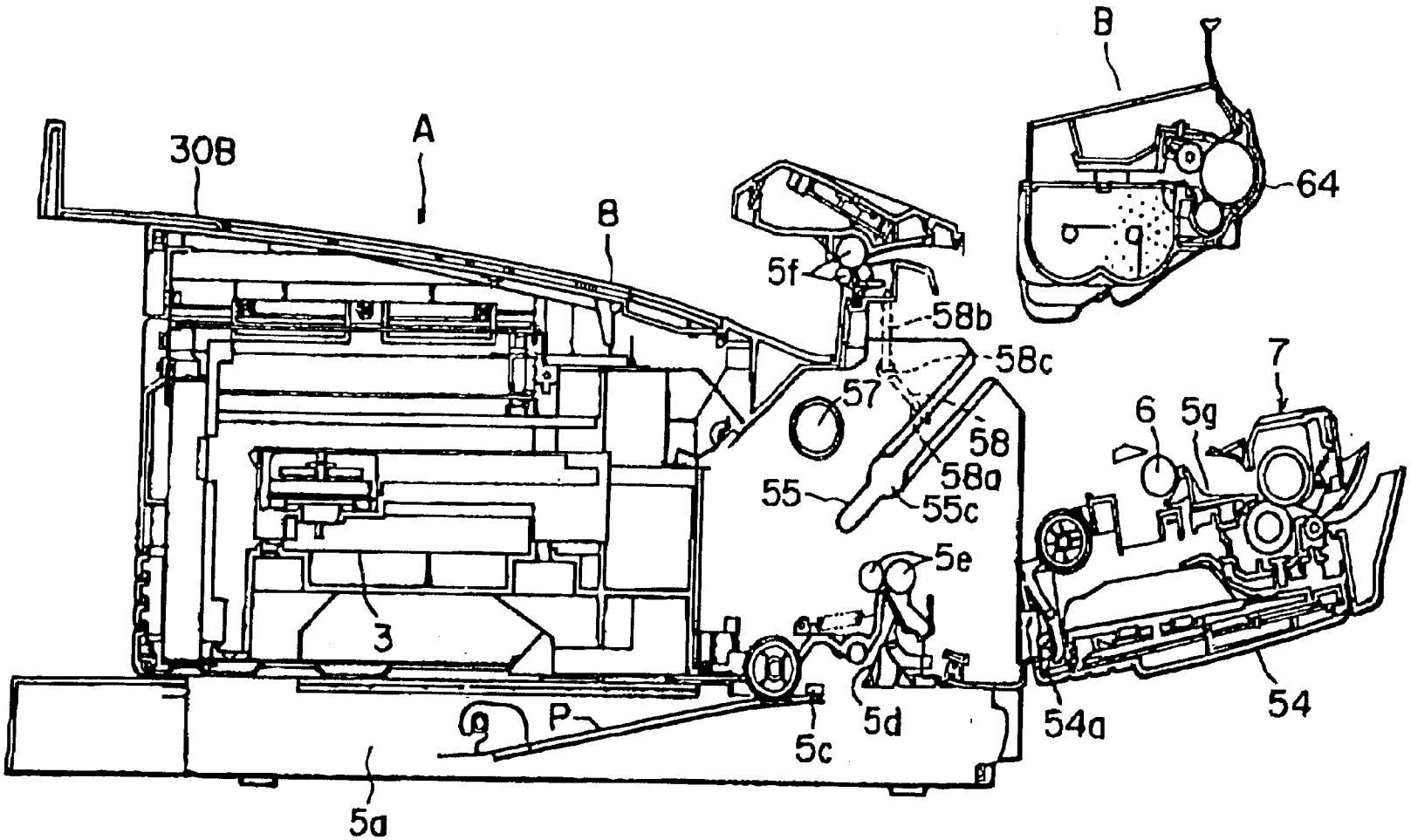
FIG. 23 is a longitudinal sectional view of an electrophotographic image forming apparatus with which the Embodiment 3 is usable.
Figure 24:
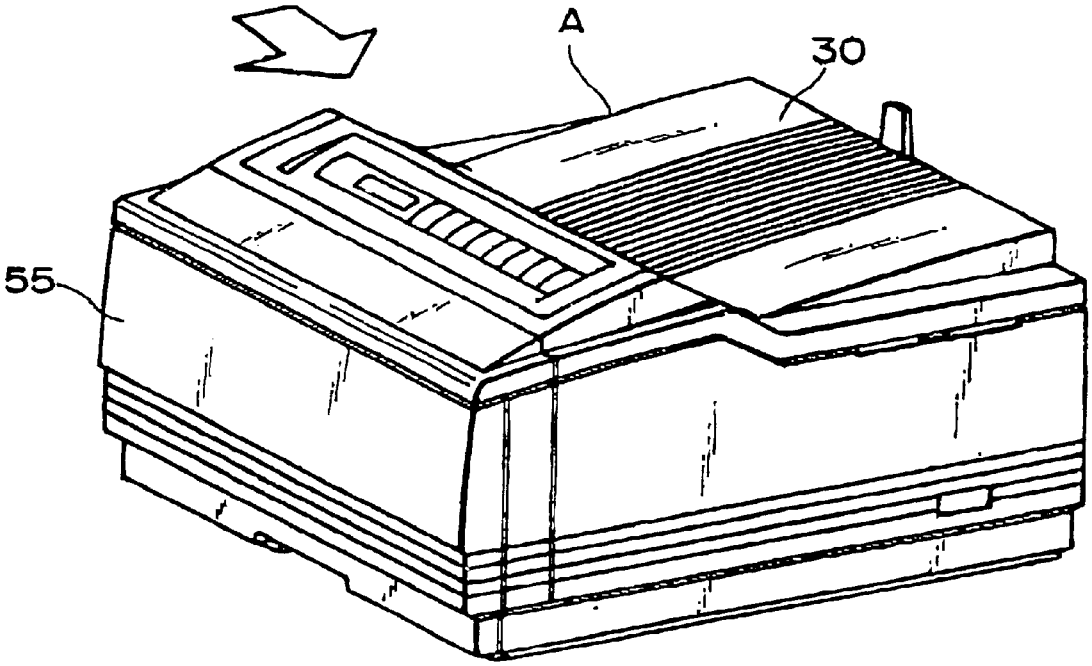
FIG. 24 is a perspective view of an electrophotographic image forming apparatus with which the Embodiment 3 is usable.

When an opening and closing member 54 is rotated about a shaft 53*a* (FIGS. 22, 23), cartridge mounting means can be seen as shown in FIG. 23. It comprises guide grooves 55 which are provided on opposite side walls (left and right) in the cartridge mounting space so to be symmetrically opposed to each other. The guide groove 55 extend downward to the front. The guide groove 55 is substantially linear. The inlet portion of the guide groove 55 is provided with a main assembly side positioning portion 55*c*.

Figure 25:
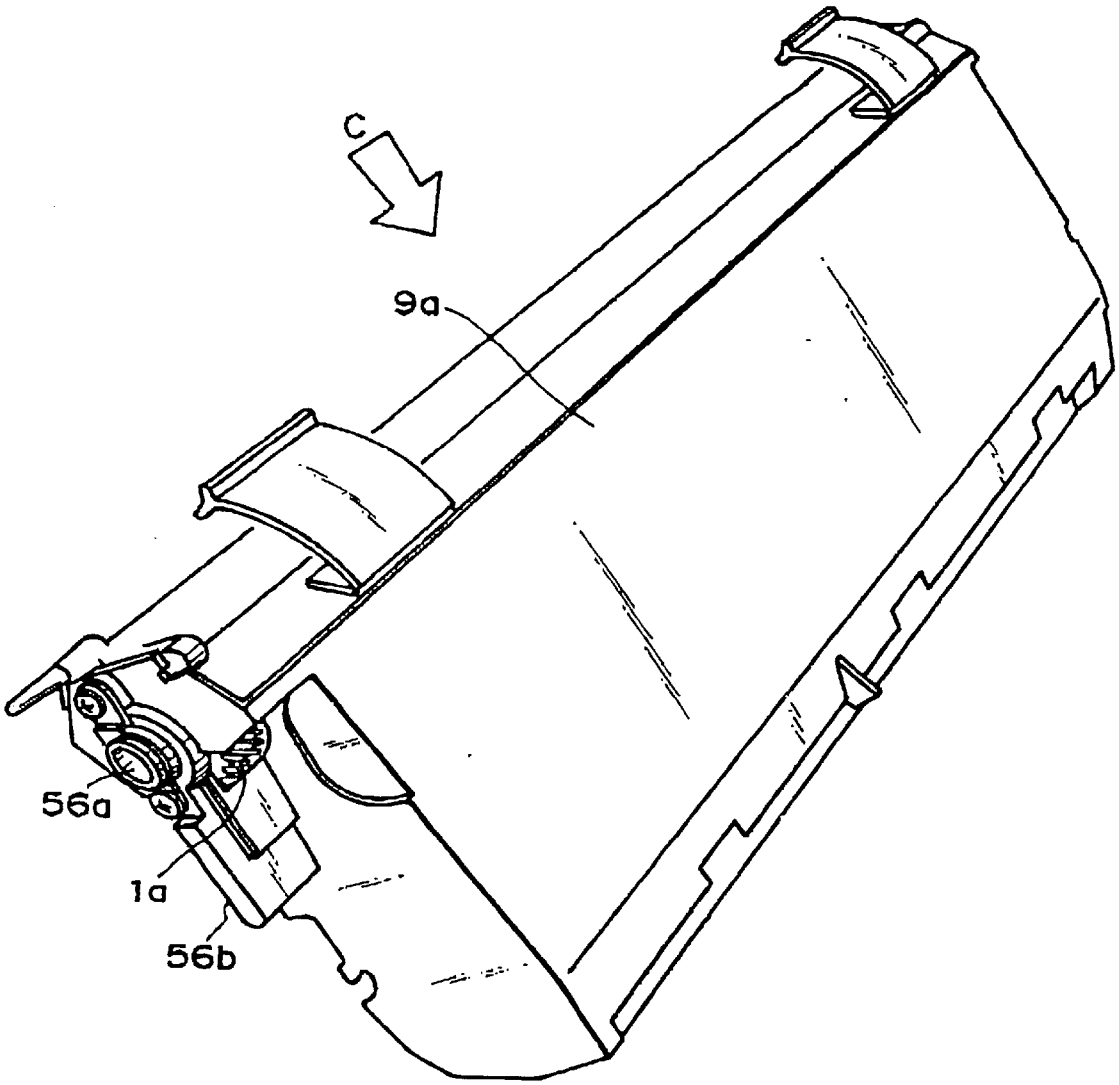
FIG. 25 is a perspective view of a process cartridge with which the Embodiment 3 is usable.

On the other hand, the process cartridge B is provided on opposite lateral sides with guide portions corresponding to the guide groove 55. The guide portions are projected from symmetrical positions of the cartridge frame. As shown in FIG. 25, it comprises an integral boss 56*a* and rib 56*b*. The boss 56*a* and the rib 56*b* are integrally formed on the cleaner container 9*a* to which the photosensitive drum 1 is mounted. The boss 56*a* is disposed on an extension of a rotation shaft of the photosensitive drum 1, and the rib 56*b* is continuously extended from the boss 56*a* toward the downstream side with respect to the inserting direction of the process cartridge B indicated by arrow C in FIG. 25. It is extended downward in the downstream direction into conformity with the guide groove 55.

With this structure, when the process cartridge B is mounted to the main assembly of the image forming apparatus, the opening and closing member 54 is opened, and the process cartridge B is inserted into the main assembly 30B of the apparatus so as to engage the rib 56*b* in the guide groove 55. Then, the boss 56*a* of the process cartridge B is seated on the main assembly positioning portion 55*c* to the inlet portions of the guide groove 55. By doing so, the drum gear 1*a* fixed to the photosensitive drum 1 at the end portion (FIG. 25) and is brought into meshing engagement with the driving gear 57 of the main assembly 30B of the apparatus (FIG. 23), so that a drive transmission connection is established between the main assembly and the process cartridge B. The drum gear 1*a* is engaged with the developing roller 5 gear A12*c* at all times (Embodiment 1).

When the opening and closing member 54 is closed, a shutter opening lever 58, which is interrelated with the opening and closing member 54, is rotated in the counterclockwise direction from a position 58*a* to a position 58*b* about the shaft 58*c*. By this, the shutter 64 is moved against an unshown spring force of a torsion coil spring to open the transfer opening 9*n*, the coil spring being engaged with a pin 64*z* of the shutter 64 and urging the shutter 64 about an unshown pin mounted on the cleaner container 9*a* in the direction of closing the transfer opening 9*n*.

When the process cartridge B is taken out, the opening and closing member 54 is opened, the shutter opening lever 58 is rotated about the shaft 58*c* and is returned from the position 58*b* to the position 58*a*. Then, the shutter 64 is rotated by the unshown spring force of the torsion coil spring about the unshown pin to close the transfer opening 9*n*. Then, the process cartridge B is lifted so that the boss 56*a* is away from the main assembly positioning portion 55*c*, and thereafter, the process cartridge B is lifted in the inclined direction so that rib 56*b* is guided along the guide groove 55. Thus, the process cartridge B is taken out.

(Automatic Unsealing Mechanism)

The automatic toner seal removing mechanism (toner opening unsealing mechanism) is similar to that of Embodiment 1, and therefore, a detailed description thereof is omitted for simplicity.

The difference from Embodiment 1 is that driving gear 57, which is a drum gear coaxially fixed to the photosensitive drum 1, is engaged with the developing roller gear A12*a* at all times.

According to the embodiments of the present invention, it is not until the process cartridge is inserted into the main assembly of the image forming apparatus that drive transmission from the main assembly of the apparatus is enabled. The seal member is not unintentionally wound up even if the driving means is actuated during the inspecting operation in the manufacturing. The driving is automatically stopped when the winding-up shaft is rotated through a predetermined number of turns, and therefore, after the sealing member is wound up to the satisfactory extent, the driving power can be saved, and the toner scattering, noise or the like due to the flappering of the seal member can be avoided.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to a main assembly of an electrophotographic image forming apparatus, comprising:

an electrophotographic photosensitive member;

developing means for developing an electrostatic latent image formed on said electrophotographic photosensitive member with a developer;

a developer container for containing the developer, said developer container having an opening for supplying the developer to said developing means;

a sealing member for sealing the opening of said developer container;

a winding member for winding said sealing member, said winding member being rotatably supported by said developer container;

driving means for applying a driving force to rotate said winding member; and driving control means for permitting and preventing transmission of a driving force to said winding member, wherein said driving control means receives the driving force from the main assembly when said process cartridge is mounted to the main assembly of the apparatus, and prevents transmission of the driving force to said winding member by displacement in interrelation with rotation of said winding member.

2. A process cartridge according to claim 1, wherein the driving force is effective to rotate said electrophotographic photosensitive member.

3. A process cartridge according to claim 1 or 2, wherein said driving control means includes a swingable gear which is swingable between a first position for permitting the transmission of the driving force to said winding member and a second position for preventing the transmission of the driving force to said winding member.

4. A process cartridge according to claim 1 or 2, wherein said driving control means includes a sliding gear movable between a disengaging position which is taken when said process cartridge is not inserted into the main assembly of the apparatus and an engaging position which is taken when said process cartridge is inserted into the main assembly of the apparatus.

5. A process cartridge according to claim 3, wherein said driving control means includes cam portion having a predetermined cam profile, a lever portion abutting said cam portion to move said swingable gear from the first position to the second position, and a Geneva gear mechanism integral with said cam portion to stop rotation of said cam portion at the second position and to maintain said cam portion at the second position.

6. An electrophotographic image forming apparatus for forming an image on a recording material, to which a process cartridge is detachably mountable, said apparatus comprising:

a. mounting means for detachably mounting the process cartridge, the process cartridge including:

an electrophotographic photosensitive member;

developing means for developing an electrostatic latent image formed on the electrophotographic photosensitive member with a developer;

a developer container for containing the developer, the developer container having an opening for supplying the developer to the developing means;

a sealing member for sealing the opening of the developer container;

a winding member for winding the sealing member, the winding member being rotatably supported by the developer container; and driving control means for permitting and preventing transmission of a driving force to the winding member, wherein the driving control means receives the driving force from a main assembly of said apparatus when the process cartridge is mounted to said main assembly of said apparatus, and prevents transmission of the driving force to the winding member by displacement in interrelation with rotation of the winding member;

b. feeding means for feeding the recording material; and c. driving means for driving the electrophotographic photosensitive member and the winding member of the process cartridge.

7. A developing cartridge detachably mountable to a main assembly of an image forming apparatus, comprising:

developing means for developing an electrostatic latent image formed on an electrophotographic photosensitive member with a developer;

a developer container for containing the developer, said developer container having an opening for supplying the developer to said developing means;

a sealing member for sealing the opening of said developer container;

a winding member for winding said sealing member, said winding member being rotatably supported by said developer container; and driving control means for permitting and preventing transmission of a driving force to said winding member, wherein said driving control means receives the driving force from the main assembly when said developing cartridge is mounted to the main assembly of the apparatus, and prevents transmission of the driving force to said winding member by displacement in interrelation with rotation of said winding member.

8. A developing cartridge according to claim 7, wherein said driving control means includes a swingable gear which is swingable between a first position for permitting the transmission of the driving force to said winding member and a second position for preventing the transmission of driving force to said winding member.

9. A developing cartridge according to claim 8, wherein said driving control means includes cam portion having a predetermined cam profile, a lever portion abutting said cam portion to move the swingable gear from the first position to the second position, and a Geneva gear mechanism integral with said cam portion to stop rotation of said cam portion at the second position and to maintain said cam portion at the second position.

10. A developing cartridge detachably mountable to a main assembly of an image forming apparatus, comprising:

developing means for developing an electrostatic latent image formed on an electrophotographic photosensitive member with a developer;

a developer container for containing the developer, said developer container having an opening for supplying the developer to said developing means;

a sealing member for sealing the opening of said developer container;

a winding member for winding said sealing member, said winding member being rotatably supported by said developer container; and driving control means for permitting and preventing transmission of a driving force to said winding member, wherein said driving control means receives the driving force from the main assembly when said developing cartridge is mounted to the main assembly of the apparatus, and prevents transmission of the driving force to said winding member in response to a predetermined number of rotations of said winding member, wherein said driving control means includes a sliding gear movable between a disengaging position which is taken when said developing cartridge is not inserted into the main assembly of the apparatus and an engaging position which is taken when said developing cartridge is inserted into the main assembly of the apparatus.

11. An electrophotographic image forming apparatus for forming an image on a recording material, to which a developing cartridge is detachably mountable, comprising:

a. mounting means for detachably mounting the developing cartridge, the developing cartridge including:

developing means for developing an electrostatic latent image formed on an electrophotographic photosensitive member with a developer;

a developer container for containing the developer, the developer container having an opening for supplying the developer to the developing means;

a sealing member for sealing the opening of the developer container;

a winding member for winding the sealing member, the winding member being rotatably supported by the developer container; and driving control means for permitting and preventing transmission of a driving force to the winding member, wherein the driving control means receives the driving force from a main assembly of said apparatus when the developing cartridge is mounted to said main assembly of said apparatus, and prevents transmission of the driving force to the winding member by displacement in interrelation with rotation of the winding member;

b. feeding means for feeding the recording material; and c. driving means for driving the winding member of the developing cartridge.

12. A process cartridge detachably mountable to a main assembly of an electrophotographic image forming apparatus, comprising:

an electrophotographic photosensitive member;

developing means for developing an electrostatic latent image formed on said electrophotographic photosensitive member with a developer;

a developer container for containing the developer, said developer container having an opening for supplying the developer to said developing means;

a sealing member for sealing the opening of said developer container;

a winding member for winding said sealing member, said winding member being rotatably supported by said developer container; and driving control means for permitting and preventing transmission of a driving force to said winding member, wherein said driving control means receives the driving force from the main assembly when said process cartridge is mounted to the main assembly of the apparatus, and prevents transmission of the driving force to said winding member in response to a predetermined number of rotations of said winding member, wherein said driving control means includes a swingable gear which is swingable between a first position for permitting the transmission of the driving force to said winding member and a second position for preventing the transmission of the driving force to said winding member, and wherein said driving control means includes a cam portion having a predetermined cam profile, lever portion abutted to said cam portion to move the swingable gear from the first position to the second position, and a Geneva gear mechanism integral with said cam portion to stop rotation of said cam portion at the second position and to maintain said cam portion at the second position.

13. A process cartridge according to claim 12, wherein the driving force is effective to rotate said electrophotographic photosensitive member.

14. A process cartridge according to claim 12 or 13, wherein said driving control means includes a sliding gear movable between a disengaging position which is taken when said process cartridge is not inserted into the main assembly of the apparatus and an engaging position which is taken when said process cartridge is inserted into the main assembly of the apparatus.

15. An electrophotographic image forming apparatus for forming an image on a recording material, to which a process cartridge is detachably mountable, said apparatus comprising:

a. mounting means for detachably mounting the process cartridge, the process cartridge including:
an electrophotographic photosensitive member;
developing means for developing an electrostatic latent image formed on the electrophotographic photosensitive member with a developer;
a developer container for containing the developer, the developer container having an opening for supplying the developer to the developing means;
a sealing member for sealing the opening of the developer container;
a winding member for winding the sealing member, the winding member being rotatably supported by the developer container;
driving control means for permitting and preventing transmission of a driving force to the winding member, wherein the driving control means receives the driving force from a main assembly of said apparatus when the process cartridge is mounted to said main assembly of said apparatus, and prevents transmission of the driving force to the winding member in response to a predetermined number of rotations of the winding member,
wherein the driving control means includes a swingable gear which is swingable between a first position for permitting the transmission of the driving force to the winding member and a second position for preventing the transmission of driving force to the winding member, and
wherein the driving control means includes a cam portion having a predetermined cam profile, a lever portion abutting the cam portion to move the swingable gear from the first position to the second position, and a Geneva gear mechanism integral with the cam portion to stop rotation of the cam portion at the second position and to maintain the cam portion at the second position;

b. feeding means for feeding the recording material; and c. driving means for driving the electrophotographic photosensitive member and the winding member of the process cartridge.

16. A developing cartridge detachably mountable to a main assembly of an image forming apparatus, comprising:

developing means for developing an electrostatic latent image formed on an electrophotographic photosensitive member with a developer;

a developer container for containing the developer, said developer container having an opening for supplying the developer to said developing means;

a sealing member for sealing the opening of said developer container;

a winding member for winding said sealing member, said winding member being rotatably supported by said developer container; and driving control means for permitting and preventing transmission of a driving force to said winding member, wherein said driving control means receives the driving force from the main assembly when said developing cartridge is mounted to the main assembly of the apparatus, and prevents transmission of the driving force to said winding member in response to a predetermined number of rotations of said winding member, wherein said driving control means includes a swingable gear which is swingable between a first position for permitting the transmission of the driving force to said winding member and a second position for preventing the transmission of driving force to said winding member, and wherein said driving control means includes a cam portion having a predetermined cam profile, a lever portion abutting said cam portion to move the swingable gear from the first position to the second position, and a Geneva gear mechanism integral with said cam portion to stop rotation of said cam portion at the second position and to maintain said cam portion at the second position.

17. A developing cartridge according to claim 16, wherein said driving control means includes a sliding gear movable between a disengaging position which is taken when said developing cartridge is not inserted into the main assembly of the apparatus and an engaging position which is taken when said developing cartridge is inserted into the main assembly of the apparatus.

18. An electrophotographic image forming apparatus for forming an image on a recording material, to which a developing cartridge is detachably mountable, comprising:

a. mounting means for detachably mounting the developing cartridge, the developing cartridge including:
developing means for developing an electrostatic latent image formed on an electrophotographic photosensitive member with a developer;
a developer container for containing the developer, the developer container having an opening for supplying the developer to the developing means;
a sealing member for sealing the opening of the developer container;
a winding member for winding the sealing member, the winding member being rotatably supported by the developer container; and
driving control means for permitting and preventing transmission of a driving force to the winding member, wherein the driving control means receives the driving force from a main assembly of said apparatus when the developing cartridge is mounted to said main assembly of said apparatus, and prevents transmission of the driving force to the winding member in response to a predetermined number of rotations of the winding member,
wherein the driving control means includes a swingable gear which is swingable between a first position for permitting the transmission of the driving force to the winding member and a second position for preventing the transmission of the driving force to the winding member, and
wherein the driving control means includes a cam portion having a predetermined cam profile, a lever portion abutting the cam portion to move the swingable gear from the first position to the second position, and a Geneva gear mechanism integral with the cam portion to stop rotation of the cam portion at the second position and to maintain the cam portion at the second position;

b. feeding means for feeding the recording material; and c. driving means for driving the winding member of the developing cartridge.

* * * * *

UNITED STATES PATENT AND TRADEMARK OFFICE

CERTIFICATE OF CORRECTION

PATENT NO. : 6,735,403 B2
DATED : May 11, 2004
INVENTOR(S) : Kazuhiko Kanno et al.

It is certified that error appears in the above-identified patent and that said Letters Patent is hereby corrected as shown below:

Title page,
Item [56], References Cited, U.S. PATENT DOCUMENTS, "5,493,327 2/1996 McCallum et al." should read -- 5,495,327 2/1996 Inomata --.

Column 5,
Line 11, "printers." should read -- printer. --.
Line 13, "described" should read -- described in --.
Line 35, close up the right margin.

Column 6,
Line 17, "above-described" should read -- above-described --.

Column 7,
Line 23, "in" should read -- is --.

Column 8,
Line 5, "above mentioned" should read -- above-mentioned --.
Line 48, "medium P." should read -- medium P. ¶Mounting of Development Cartridge into Image Forming Apparatus Main Assembly --.

Column 14,
Line 8, "in" should read -- is --.
Line 21, "seen" should read -- seen in --.

Column 15,
Line 30, "and" should be deleted.

Signed and Sealed this

Second Day of November, 2004

JON W. DUDAS
*Director of the United States Patent and Trademark Office*